US010071792B2

(12) United States Patent
Montousse

(10) Patent No.: US 10,071,792 B2
(45) Date of Patent: Sep. 11, 2018

(54) UNDERWATER PERSONAL SUBMERSIBLE

(71) Applicant: Julien Montousse, Los Angeles, CA (US)

(72) Inventor: Julien Montousse, Los Angeles, CA (US)

( * ) Notice: Subject to any disclaimer, the term of this patent is extended or adjusted under 35 U.S.C. 154(b) by 495 days.

(21) Appl. No.: 14/150,609

(22) Filed: Jan. 8, 2014

(65) Prior Publication Data

US 2014/0193206 A1 Jul. 10, 2014

Related U.S. Application Data

(60) Provisional application No. 61/751,008, filed on Jan. 10, 2013.

(51) Int. Cl.
*B63C 11/10* (2006.01)
*B63C 11/46* (2006.01)
*B63G 8/00* (2006.01)

(52) U.S. Cl.
CPC ..... *B63C 11/46* (2013.01); *B63G 8/001* (2013.01)

(58) Field of Classification Search
CPC ..... B63C 11/30; B63C 11/02; B63C 11/2245; B63C 2011/085; B63C 2011/306; B63C 11/00; B63C 11/42; B63G 8/001; B63G 8/00; B63G 8/08
USPC ..... 405/185, 186, 188, 189, 190, 191, 192, 405/193; 114/312, 313, 315, 321, 330, 114/331, 332, 333, 334, 335, 337, 338
See application file for complete search history.

(56) References Cited

U.S. PATENT DOCUMENTS 1,324,961 A * 12/1919 Grantham ..... B63G 8/24 114/330
1,926,229 A * 9/1933 Deschenes ..... B63G 8/41 114/325
3,048,140 A * 8/1962 Davis, Sr. ..... A63B 35/125 440/38
3,129,681 A * 4/1964 Bajulaz ..... B63G 8/001 114/333
3,131,664 A * 5/1964 McInvale ..... B63C 11/46 114/315
3,160,133 A * 12/1964 Walker ..... A63H 23/00 114/245
3,204,596 A * 9/1965 Fallon ..... B63C 11/46 114/25

(Continued)

FOREIGN PATENT DOCUMENTS

CN 201350967 11/2009
CN 201350967 Y * 11/2009

(Continued)

OTHER PUBLICATIONS

International Search Report re International Application No. PCT/US2014/010757 dated Apr. 28, 2014, in 10 pages.

*Primary Examiner* — Benjamin F Fiorello
*Assistant Examiner* — Edwin J Toledo-Duran
(74) *Attorney, Agent, or Firm* — Knobbe Martens Olson & Bear LLP

(57) ABSTRACT

An underwater personal submersible is provided. The underwater personal submersible can include a main body comprising a tripod structure of two forward-swept stabilizing surfaces and a main section including a user compartment, a plurality of oxygen tanks, and a propulsion mechanism. The placement of the propulsion mechanism and the stabilizing surfaces increases the maneuverability of the submersible.

14 Claims, 19 Drawing Sheets

(56) References Cited

U.S. PATENT DOCUMENTS 3,543,712 A * 12/1970 Vasilatos ..... A63B 35/12 441/55
3,688,720 A * 9/1972 Lok ..... B63C 11/42 114/333
4,423,695 A * 1/1984 Rougerie ..... B63B 1/10 114/125
5,237,952 A * 8/1993 Rowe ..... B63B 11/04 114/280
5,433,164 A * 7/1995 Sneath ..... B63C 11/46 114/315
D399,183 S * 10/1998 Ciamillo, II ..... D12/308
5,988,096 A * 11/1999 Benesch ..... B63G 8/42 114/244
5,997,369 A * 12/1999 Triantafyllou ..... B63B 1/36 114/67 R
6,033,276 A * 3/2000 Han ..... B63C 11/49 114/315
6,089,178 A * 7/2000 Yamamoto ..... B63G 8/08 114/337
D447,109 S * 8/2001 Paoli ..... D12/308
6,581,537 B2 * 6/2003 McBride ..... B63G 8/16 114/312
6,606,960 B1 * 8/2003 Leibolt ..... B63C 11/02 114/315
6,805,064 B1 10/2004 Anderson
8,869,724 B2 * 10/2014 von der Goltz ..... B63B 35/73 114/66
2007/0044973 A1 * 3/2007 Fraser ..... E21B 17/01 166/367

FOREIGN PATENT DOCUMENTS

DE 23 03 019 A1 8/1974
DE 2303019 8/1974
FR 2 530 577 A1 2/1984
FR 2 541 229 A1 8/1984

* cited by examiner

UNDERWATER PERSONAL SUBMERSIBLE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of U.S. Provisional Application No. 61/751,008, entitled "UNDERWATER PERSONAL SUBMERSIBLE," filed Jan. 10, 2013, the entirety of which is incorporated herein by reference.

FIELD OF THE INVENTION

The invention relates generally to submersible personal mobility devices.

DESCRIPTION OF THE RELATED ART

Protective coverings for persons during underwater activities are generally well known. Such previously known protective coverings may be made of water resistant, semi-rigid materials and have viewing facilities. Other known submersible devices comprise a sealed chamber which may house one or more persons. In such devices, a user enters the chamber via a hatch and has a supply of air onboard the submersible device.

SUMMARY OF THE INVENTION

One aspect of at least one embodiment of the invention is the recognition that it would be desirable to have a protective covering for underwater activities that would not require that a user be equipped with full diving equipment in order to be able to breathe underwater. Likewise, it would be desirable that such a covering not require specialized training, such as diving certifications. One embodiment of an underwater personal mobility device is disclosed in U.S. patent application Ser. No. 13/533,541, filed Jun. 26, 2012, which is hereby incorporated by reference in its entirety.

Another aspect of at least one embodiment of the present invention is the recognition that many submersible devices are not highly maneuverable underwater. Additionally, many submersible devices are not configured to lift and tow substantial payloads while remaining stable and easily controlled within the water.

Yet another inventive aspect of at least one embodiment of the present invention is the recognition that a personal submersible device that allows a user to operate the unit without requiring the user to wear full diving equipment or necessitating a tether to the surface would have many benefits. These benefits would include increased flexibility of use, as such a device could be used by a greater number of people, including tourists or scientists, without requiring extensive training or equipment. The personal submersible device could also be easier to manipulate and transport, particularly if the device were able to fold for transportation and storage.

In addition to user-related advantages, another inventive aspect of at least one embodiment of the invention is the recognition that it would be desirable to provide a personal submersible device which provides an ecological advantage through the use of renewable energy sources. These sources may be used to provide power to various components of the unit and may comprise solar panels installed on the device to provide solar-generated electrical power to be used, for example, by an electrical air pump or electric motor.

Yet another inventive aspect of at least one embodiment of the present invention is the recognition that it would be desirable to mount a three dimensional, high definition video camera to the personal submersible device to capture and map the details of reefs located up to 1500 meters or approximately 5000 feet below the surface.

Additionally, another inventive aspect of at least one embodiment of the present invention is the recognition that it would be desirable to mount a manipulator arm to the submersible. The manipulator arm may be remotely operated by the user inside a pressurized chamber. Desirably, the submersible has a wide vision angle capability such that the user can manipulate the arm and solve a variety of subsea challenges, such as the manipulation of equipment for subsea oil and gas application.

In yet another inventive aspect of at least one embodiment of the present invention, the volume of air within a pressurized chamber of the submersible may also be changed. In such embodiments, the submersible would have a reduced overall weight. The reduced weight would desirably increase the maneuverability of the submersible and enable easier transportation of the submersible device. Furthermore, reducing the volume of air within the pressurized cabin could also decrease manufacturing costs. In some embodiments, vacuum systems and hydraulic valves may inflate a saline solution gel or salt water into targeted cushions within the pressurized chamber. The inflation of these cushions or pockets desirably offers a more ergonomic posture for the user and also eliminates dead space unused during operation of the submersible. Additionally, the inflation of these cushions with saline gel or salt water reduces the overall volume of air within the pressurized chamber and to allow the submersible to obtain further negative buoyancy and descend deeper in the water.

In one aspect, an underwater personal submersible includes a main body, the main body including a forward observation chamber, a first forward side support assembly on one side of the main body, a second forward side support assembly on an opposite side of the main body, and a rear support. The first forward support assembly and said second forward support assembly define an open viewing space between one another from a front of the forward observation chamber. In some aspects, the open viewing space defines a viewing angle of at least 45 degrees from the front of the forward observation chamber and, desirably, from the center point of the forward observation chamber. In some aspects, the open viewing space defines a viewing angle of at least 90 degrees from front of the forward observation chamber. In some aspects, the open viewing space defines a viewing angle of at least 135 degrees from the front of the forward observation chamber.

In some aspects, the underwater personal submersible further includes a forward user entry opening. In some aspects, the underwater personal submersible further includes a user compartment angled downward and rearward from the user entry opening when the underwater personal submersible is positioned on a horizontal surface. In some aspects, the user compartment is angled downward at least 20 degrees when the underwater personal submersible is positioned on a horizontal surface. In some aspects, the underwater personal submersible further includes at least one membrane at least partially defining an inflatable chamber within the user compartment. In some aspects, the membrane provides cushioning for comfort and support of a user. In some aspects, the membrane at least partially encloses a source of ballast. In some aspects, the source of ballast is water permitted to enter the inflatable chamber. In some aspects, the underwater personal submersible further includes a valve to control the entry of ballast into the inflatable chamber. In some aspects, the inflatable chamber occupies at least 20% of an inner volume of the user compartment. In some aspects, the inflatable chamber occupies at least 30% of an inner volume of the user compartment.

In some aspects, the main body has a center of gravity, a first vertical stabilizer mechanism on one side of a vertical plane intersecting the center of gravity, and a second vertical stabilizer mechanism on an opposite side of the vertical plane intersecting the center of gravity. In some aspects, the main body defines an axis of rotation about a longitudinal axis intersecting the center of gravity and the first and second vertical stabilizer mechanisms control rotation of the main body about the longitudinal axis. The underwater personal submersible further includes a secondary ballast system comprising at least one inflatable membrane located within the user compartment and configured to inflate and conform to the user's body within the user compartment to provide comfort for the user during operation of the submersible.

In some aspects, the underwater personal submersible further includes at least one propulsion mechanism located rearward from each of the first and second vertical stabilizer mechanisms. In some aspects, the underwater personal submersible further includes at least one propulsion mechanism located at a rear portion of the personal submersible.

In some aspects, the first and second side support assemblies together define at least 17% of the weight of the personal submersible. In some aspects, the first and second side support assemblies together define at least 24% of the weight of the personal submersible. In some aspects, the first and second side support assemblies extend at least two feet to the side of the main body. In some aspects, the first and second side support assemblies extend at least three feet to the side of the main body. In some aspects, the total weight of the underwater personal submersible is less than 4000 lbs. In some aspects, the total weight of the underwater personal submersible is less than 3000 lbs.

In some aspects, the underwater personal submersible further includes a support member located on an outward end of each side support such that the support members and the rear support form three support points to support the submersible on a solid surface. In some aspects, the underwater personal submersible further includes a plurality of attachment members configured such that the submersible can lift and transport an object while underwater and while remaining vertically stable. In some aspects, the underwater personal submersible further includes a manipulable member connected to the underside of the submersible and configured such that the submersible can lift and transport an object while underwater and while remaining vertically stable.

In another aspect, an underwater personal submersible includes a main body having a center of gravity, a first vertical stabilizer mechanism on one side of a vertical plane intersecting the center of gravity, a second vertical stabilizer mechanism on an opposite side of the vertical plane intersecting the center of gravity, and a rear propulsion mechanism.

In yet another aspect, an underwater personal submersible includes a main body comprising a tripod structure of two forward stabilizing surfaces and a main section including a user compartment, a plurality of oxygen tanks and buoyancy compartments located near a center of gravity of the submersible, a propulsion mechanism configured to provide forward motion of the submersible, and a stabilizing mechanism configured to maneuver and rotate the submersible when the submersible is moving with low or zero forward motion. In some aspects, the propulsion mechanism includes a plurality of thruster mechanisms, each thruster mechanism comprising an inlet, a nozzle outlet, a propeller, and a steering mechanism, wherein the propeller directs water out of the nozzle outlet to propel the submersible in a determined direction and the steering mechanism is rotatable such that the submersible may be steered in the determined direction. In some aspects, each of the stabilizing surfaces includes a vertical stabilizer mechanism comprising a housing and a propeller, wherein rotation of the propellers in the same direction raises or lowers the submersible along a vertical axis through the center of gravity of the submersible and rotation of the propellers in opposite directions tilts the submersible about a longitudinal axis defined by the main body. In some aspects, the underwater personal submersible further includes a secondary ballast system including at least one inflatable membrane located within the user compartment and configured to inflate and conform to the user's body within the user compartment to provide comfort for the user during operation of the submersible.

In another aspect, an underwater personal submersible includes a tripod structure of two forward-swept stabilizing surfaces including stabilizing mechanisms and a main section including a user compartment, the main section further including an observation chamber configured to allow a user to view an environment surrounding the submersible, at least one oxygen tank, at least one buoyancy compartment, and a propulsion mechanism comprising at least one thruster mechanism.

In yet another aspect, an underwater personal submersible includes a main section including a user compartment and an observation chamber, at least one oxygen tank connected to the user compartment, at least one buoyancy compartment, and a propulsion mechanism including at least one thruster mechanism, wherein the user compartment is configured such that a user is oriented face down and inclined upwards at least 20 degrees from a horizontal position, each arm of the user is extended forward and outward within the user compartment, and the placement of the propulsion mechanism, the at least one buoyancy compartment, and the at least one oxygen tank facilitate the submersible staying stable and upright while underwater.

All of these embodiments are intended to be within the scope of the inventions herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects, and advantages of the present invention will now be described in connection with preferred embodiments of the present invention, in reference to the accompanying drawings. The illustrated embodiments, however, are merely examples and are not intended to limit the invention.

DETAILED DESCRIPTION OF THE PREFERRED EMBODIMENT

The following detailed description is directed to certain specific embodiments of the invention. However, the invention may be embodied in a multitude of different ways as defined and covered by the claims.

Figure 10:
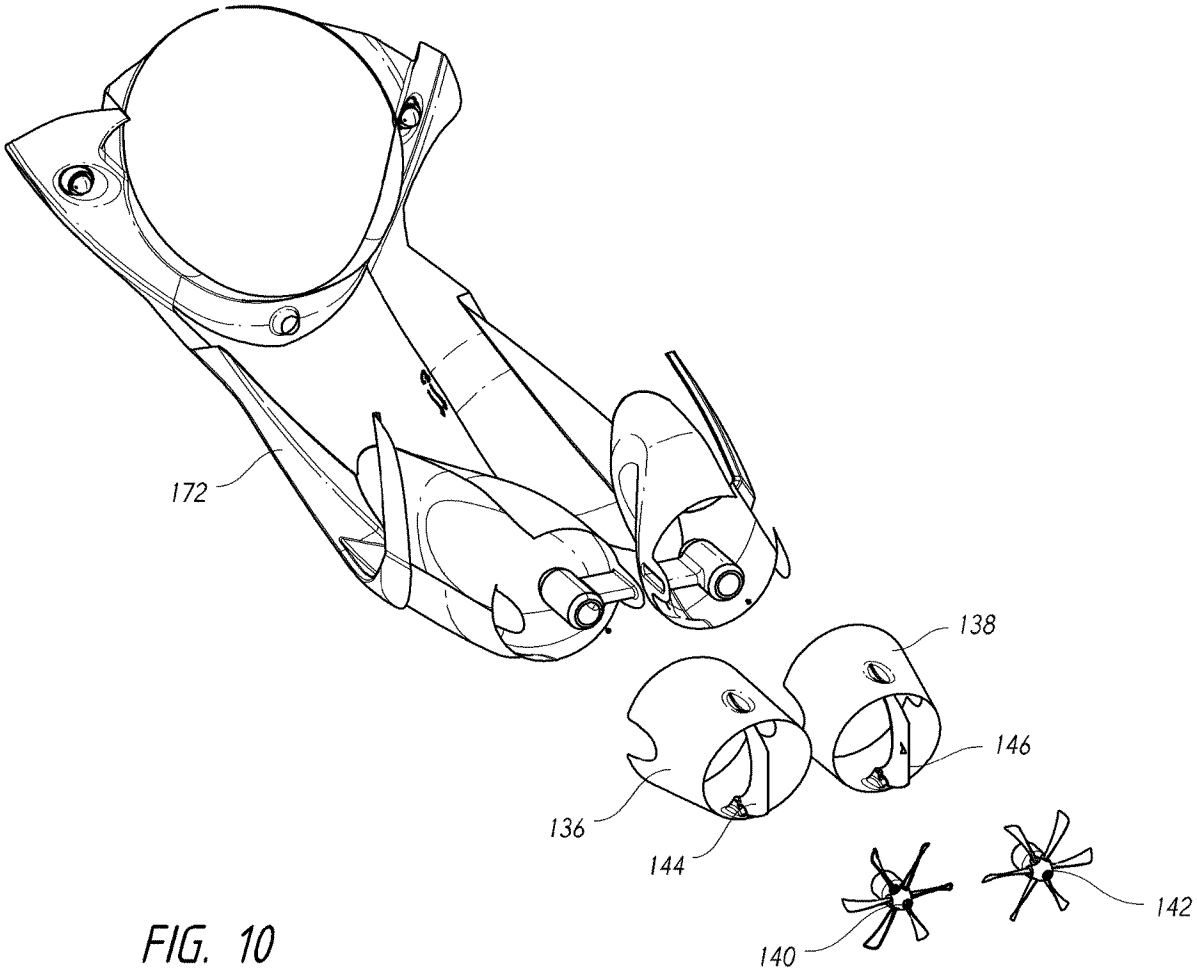
FIG. 10 is a perspective rear view of an exploded thruster mechanism assembly for an underwater personal submersible.
Figure 11:
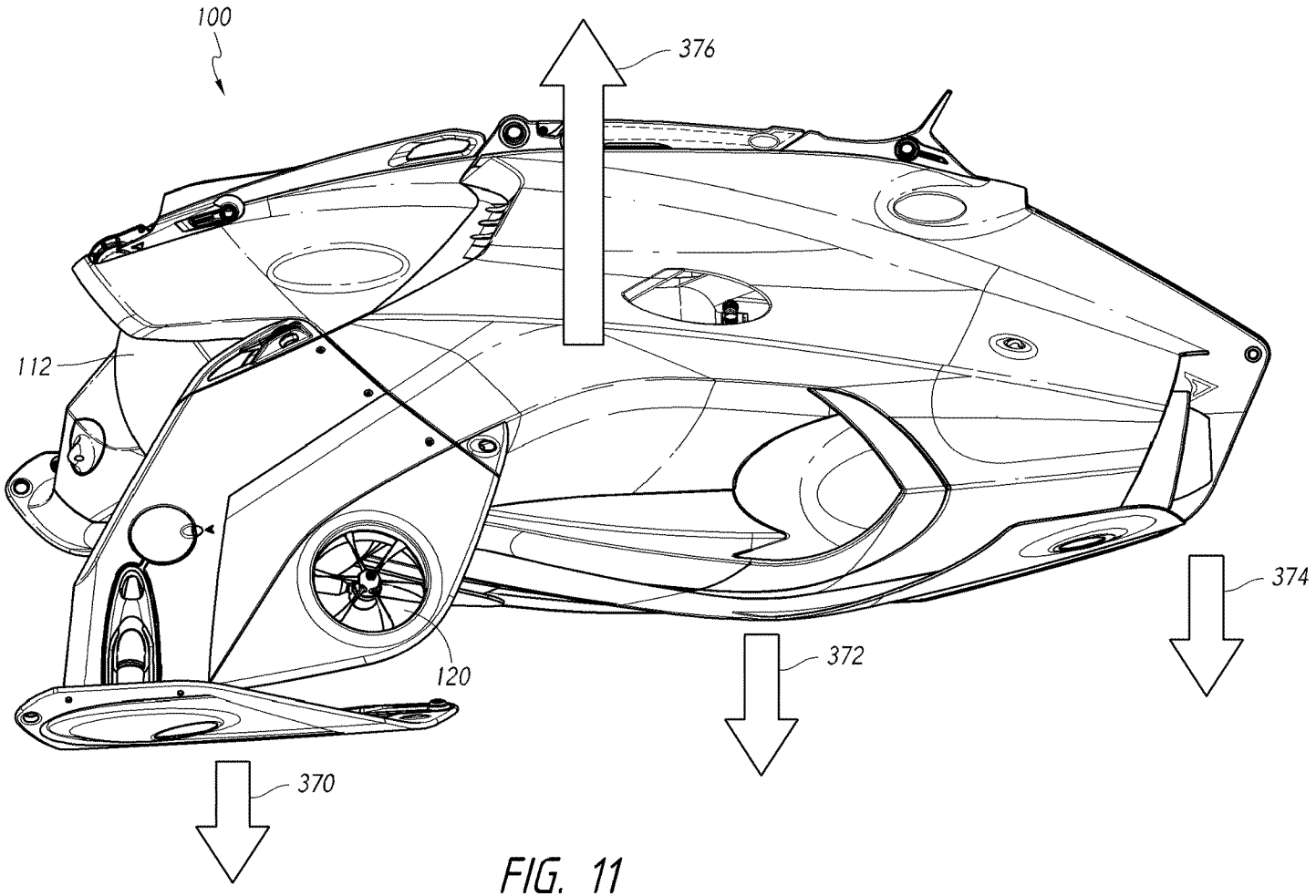
FIG. 11 is a partial left view of a buoyancy and ballast arrangement for an underwater personal submersible.
Figure 12:
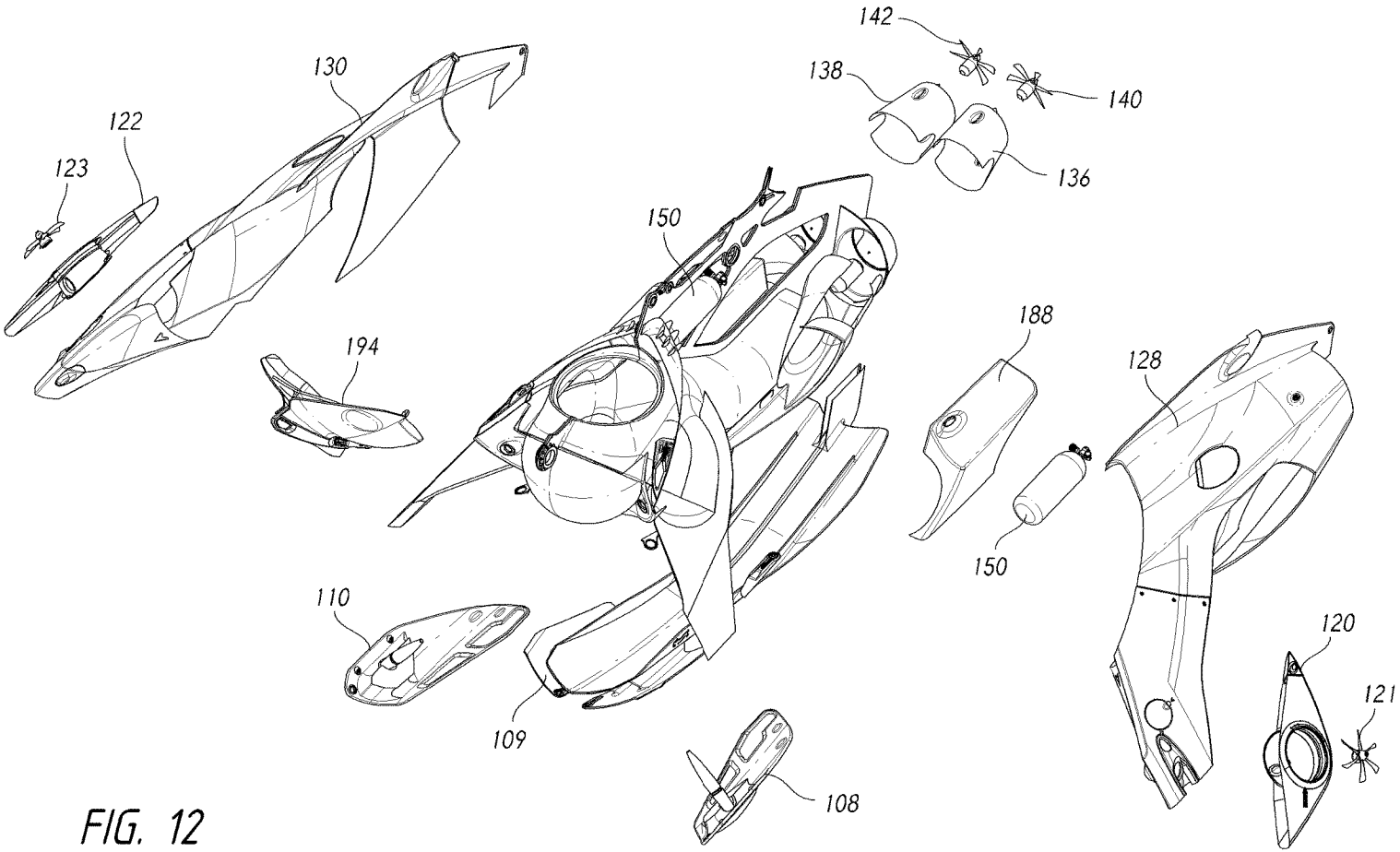
FIG. 12 is an exploded view of an underwater personal submersible.

One embodiment of an underwater personal submersible capable of transporting a human being under water is depicted in FIGS. 1-19. In a preferred embodiment, the underwater personal submersible is a personal, compact pressurized submersible capable of transporting one user underwater. One aspect of a preferred embodiment discloses an architecture in which the user is positioned face down and approximately 20 degrees up from a horizontal position while operating the submersible. The personal submersible 100 comprises a main section or fuselage 102, a left stabilizing surface or wing 104, and a right stabilizing surface or wing 106. The main section 102 may be supported, directly or indirectly, by a chassis 172 (FIG. 10). Other embodiments may not include the chassis 172. The wings 104, 106 extend outward from a forward portion of the main section or fuselage 102, as shown in FIGS. 6 and 12. As best shown in FIG. 6, the wings 104, 106 desirably connect to the main section or fuselage 102 at lines 302, 304. In some embodiments, including the illustrated embodiment, the wings 104, 106 may be integrally formed as one piece with the main section 102. In other embodiments, including the illustrated embodiment, the wings 104, 106 may be separate components that are mechanically fastened to the main section 102 at the lines 302, 304. The wings 104, 106 desirably each have a leading edge 306 and a trailing edge 308. In some embodiments, including the illustrated embodiment, the wings 104, 106 are each approximately 3 to 4 feet long from the connection with the main section or fuselage 102 at lines 302, 304 to the skis 108, 110. In some embodiments, including the illustrated embodiment, the wings 104, 106 each extend approximately about 5 to 7 feet from a vertical plane defined by the main section 102, passing through the center of gravity of the submersible 100, and perpendicular to a horizontal plane.

Figure 13:
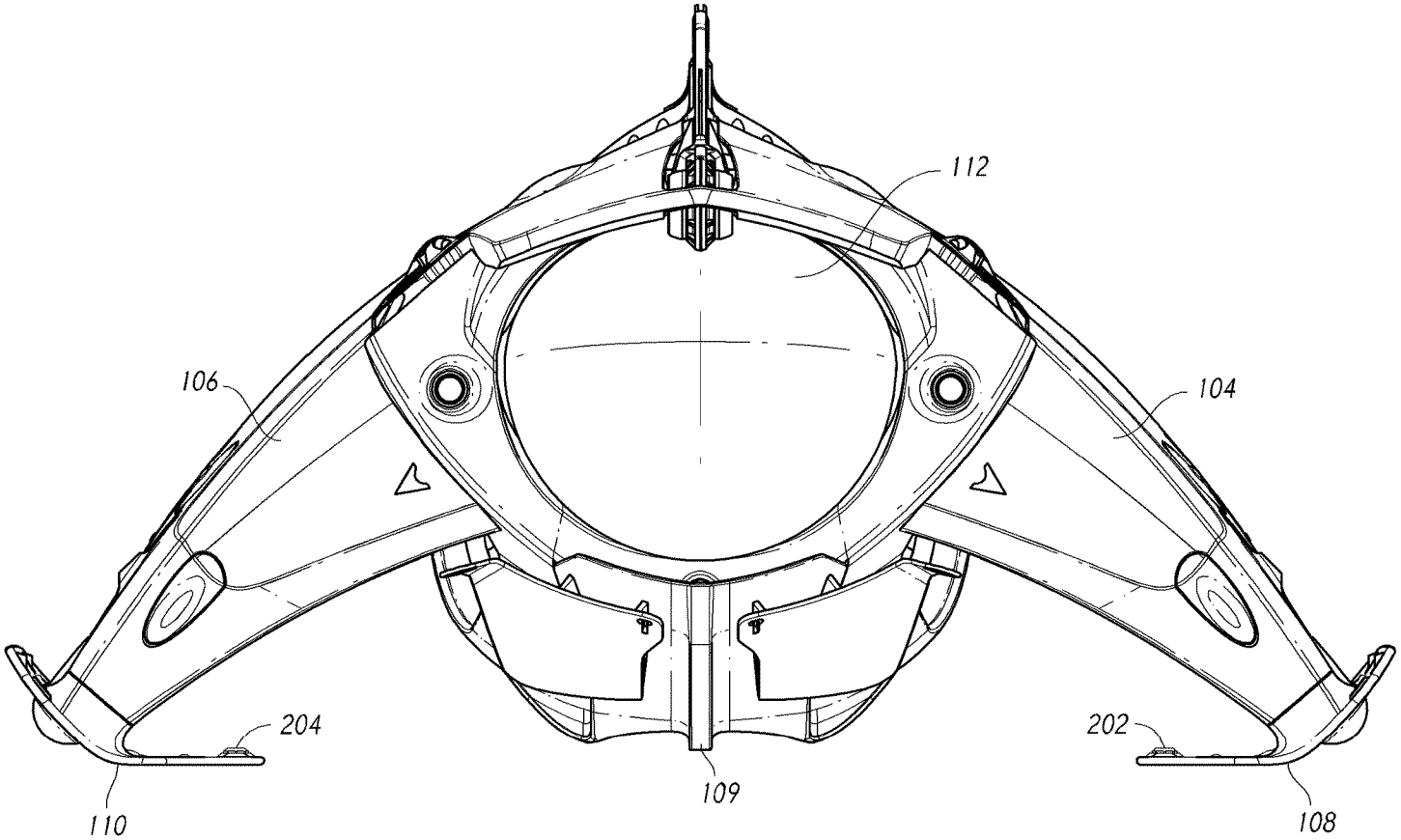
FIG. 13 is a front view of an underwater personal submersible.

In the illustrated embodiment, and as best seen in FIGS. 12 and FIG. 13, the personal submersible 100 further comprises a left support member or ski 108 attached to the bottom of the left wing 104, a right support member or ski 110 attached to the bottom of the right wing 106, and a rear support member or ski 109 attached to the bottom of the main section 102. The left support member 108 and the left wing 104 comprise a first forward side support assembly that extends outward from the main body 102 from the line 302 as shown in FIG. 6. Similarly, the right support member 110 and the right wing 106 comprise a second forward side support assembly that extends outward from the main body 102 from the line 304 as shown in FIG. 6. In some embodiments, including the illustrated embodiment, all or part of one or both of the forward side support assemblies can be integrally formed with the main section 102. In some embodiments, including the illustrated embodiment, the forward side support assemblies may be formed separately from the main section 102 and mechanically fastened to the main section 102 during manufacture of submersible 100. In some embodiments, including the illustrated embodiment, each of the forward side support assemblies extends at least two feet to the side of the main body, at least 3 feet to the side of the main body, or at least 4 feet to the side of the main body. The left ski 108, the right ski 110, and the center ski 109 are desirably able to concurrently contact the ground or bottom surface and support the submersible 100 in a "tripod" structure, as will be discussed in detail below. A horizontal plane may be defined when all three of the skis 108, 109, 110 are on the ground. A vertical plane of the submersible 100 may be defined as a plane defined by the length of the body of the submersible 100, passing through a center of gravity F of the submersible 100 (FIG. 18) and perpendicular to the horizontal plane.

Figure 5:
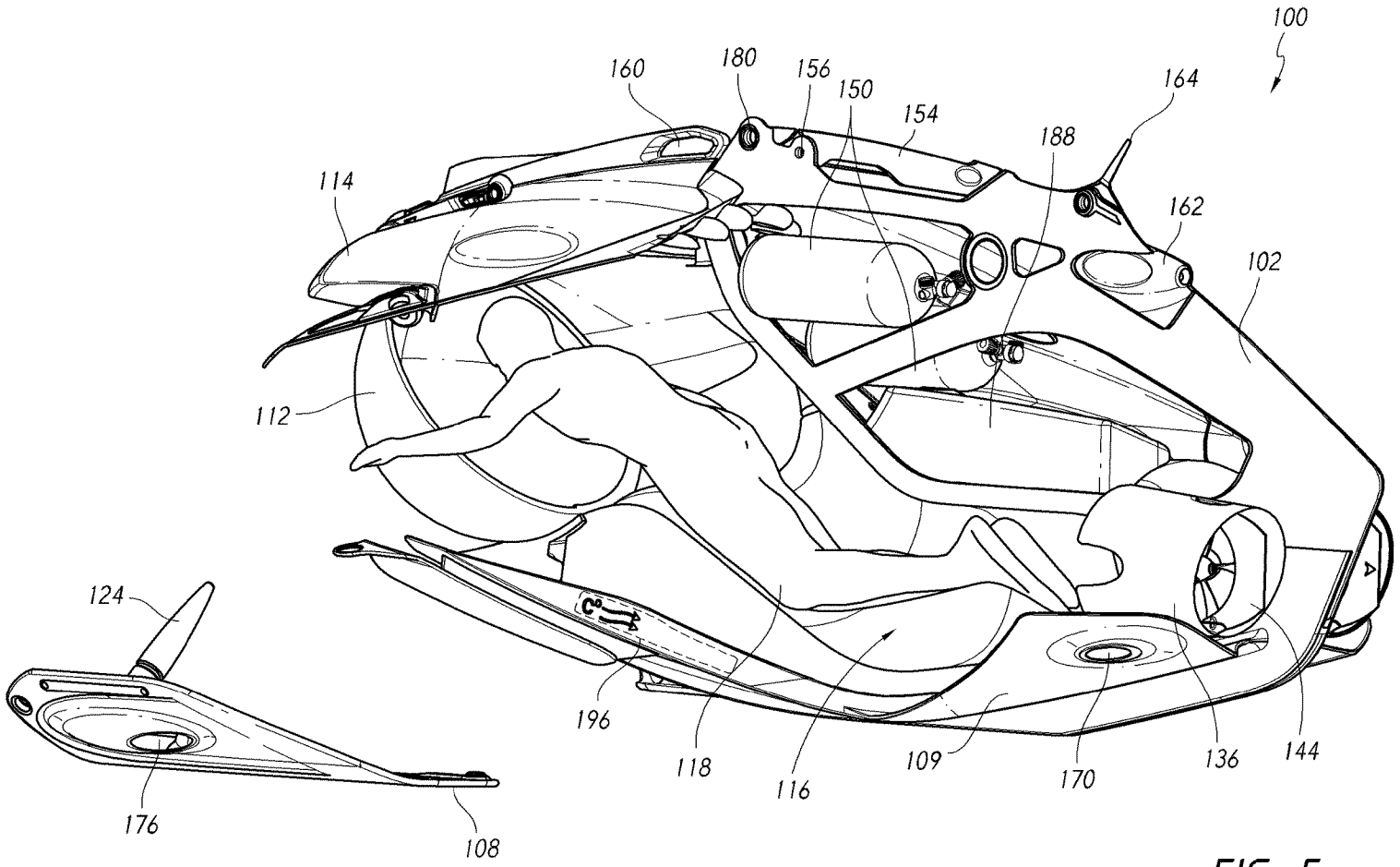
FIG. 5 is a partial perspective rear left view of an underwater personal submersible and a user thereof.
Figure 6:
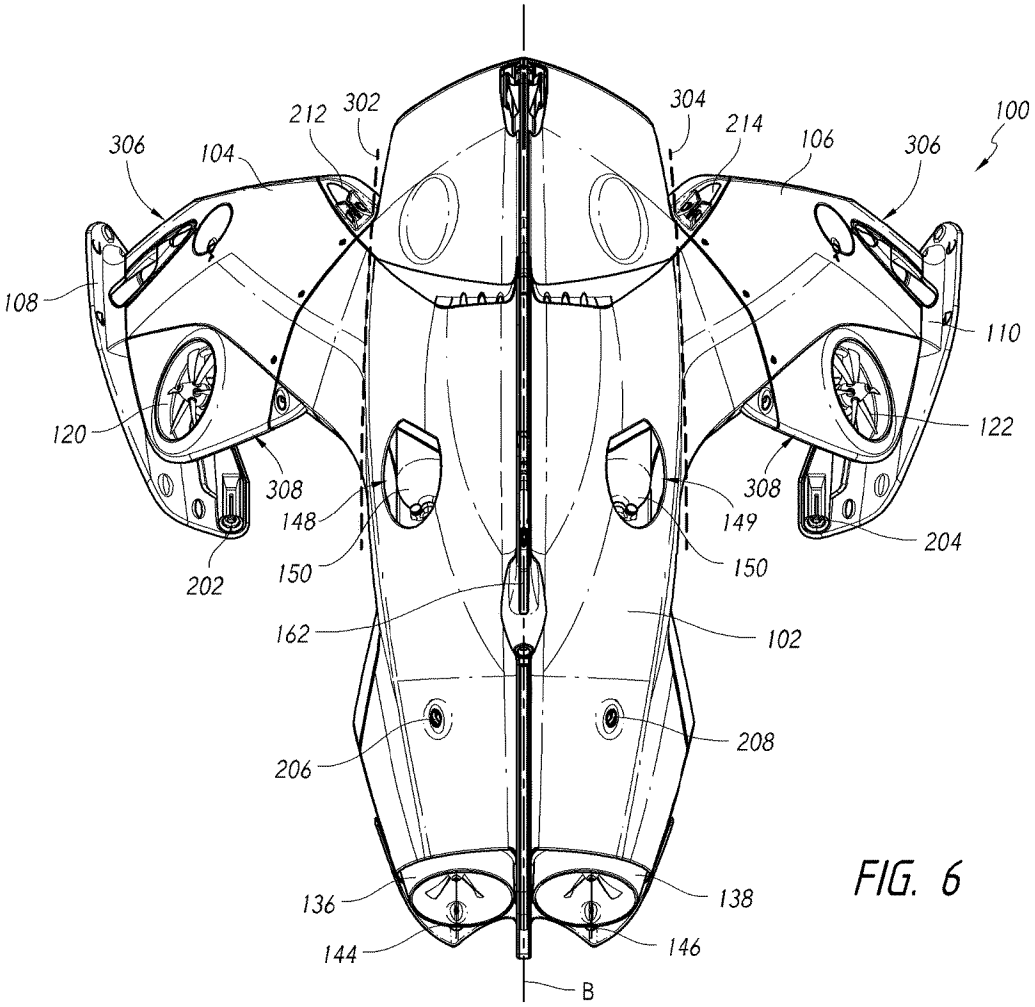
FIG. 6 is a top view of an underwater personal submersible.
Figure 8:
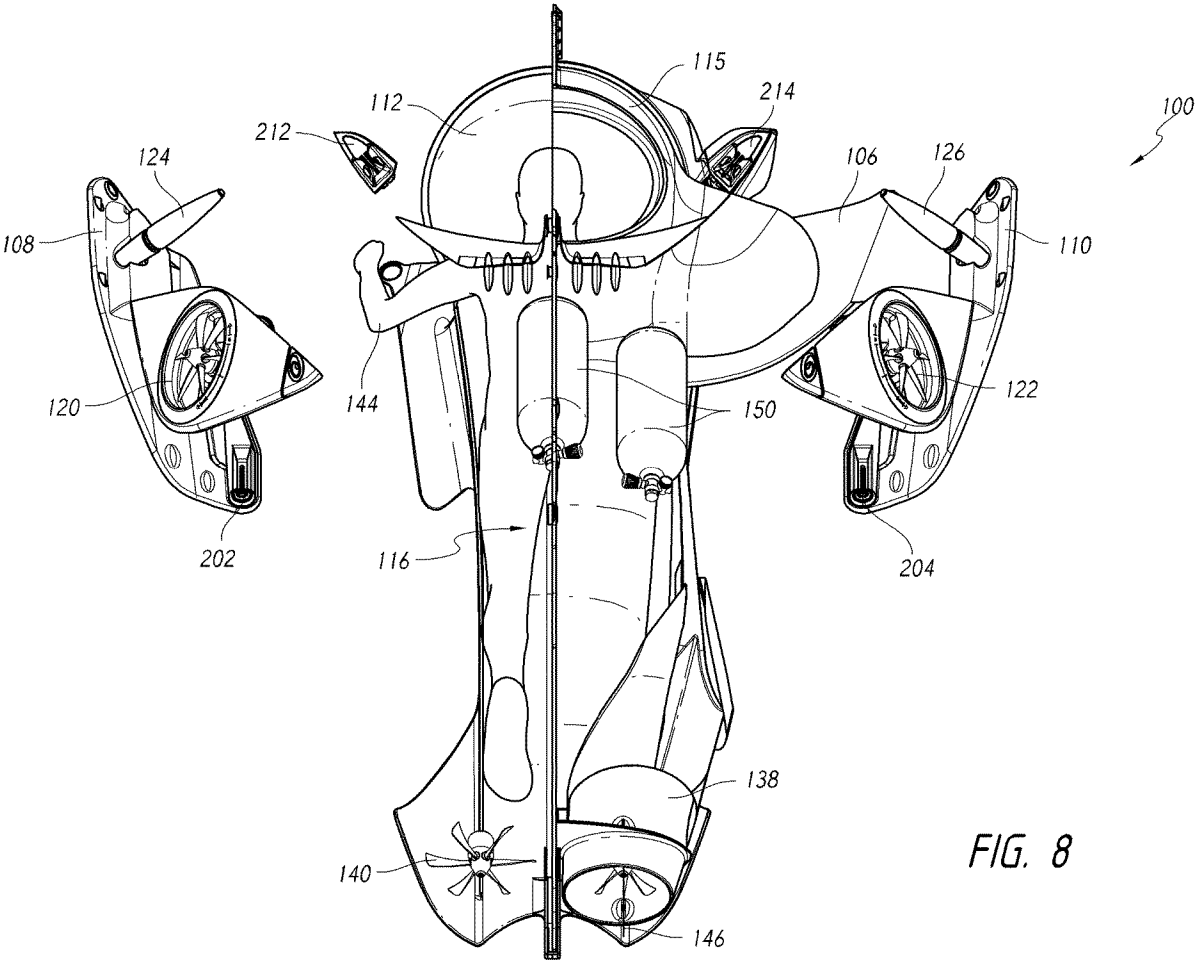
FIG. 8 is a second partial top view of an underwater personal submersible.

To facilitate understanding of the invention, the illustrated embodiments are described in the context of an orientation system based on a user 118 facing forward as shown, for example, in FIGS. 5 and 8. Thus, the right side of the device corresponds to the user's right side, the left side of the device corresponds to the user's left side, and the front of the device corresponds to the front of the user's face when the user is facing directly forward with the chin extended horizontally. Note, in FIGS. 5 and 8, the user is facing downward approximately at least 20 degrees to approximately at least 35 degrees up from a horizontal position, which provides a comfortable viewing angle for the user while operating the submersible. Desirably, a centerline of the user compartment 116 and/or the user are angled downward approximately at least 15 degrees to approximately at least 35 degrees when the submersible is positioned on a horizontal surface.

FIGS. 1-6 depict a preferred embodiment having certain features, aspects, and advantages of the present invention. FIGS. 1-4 depict views of the left side of a preferred embodiment of a personal underwater submersible 100. FIG. 5 depicts the same embodiment as that shown in FIGS. 1-4 but also includes a user 118 interacting with the submersible 100. FIG. 6 illustrates a top view of the personal submersible 100. Personal underwater submersible 100 may include more, fewer, or different components than those shown in FIGS. 1-6.

Figure 1:
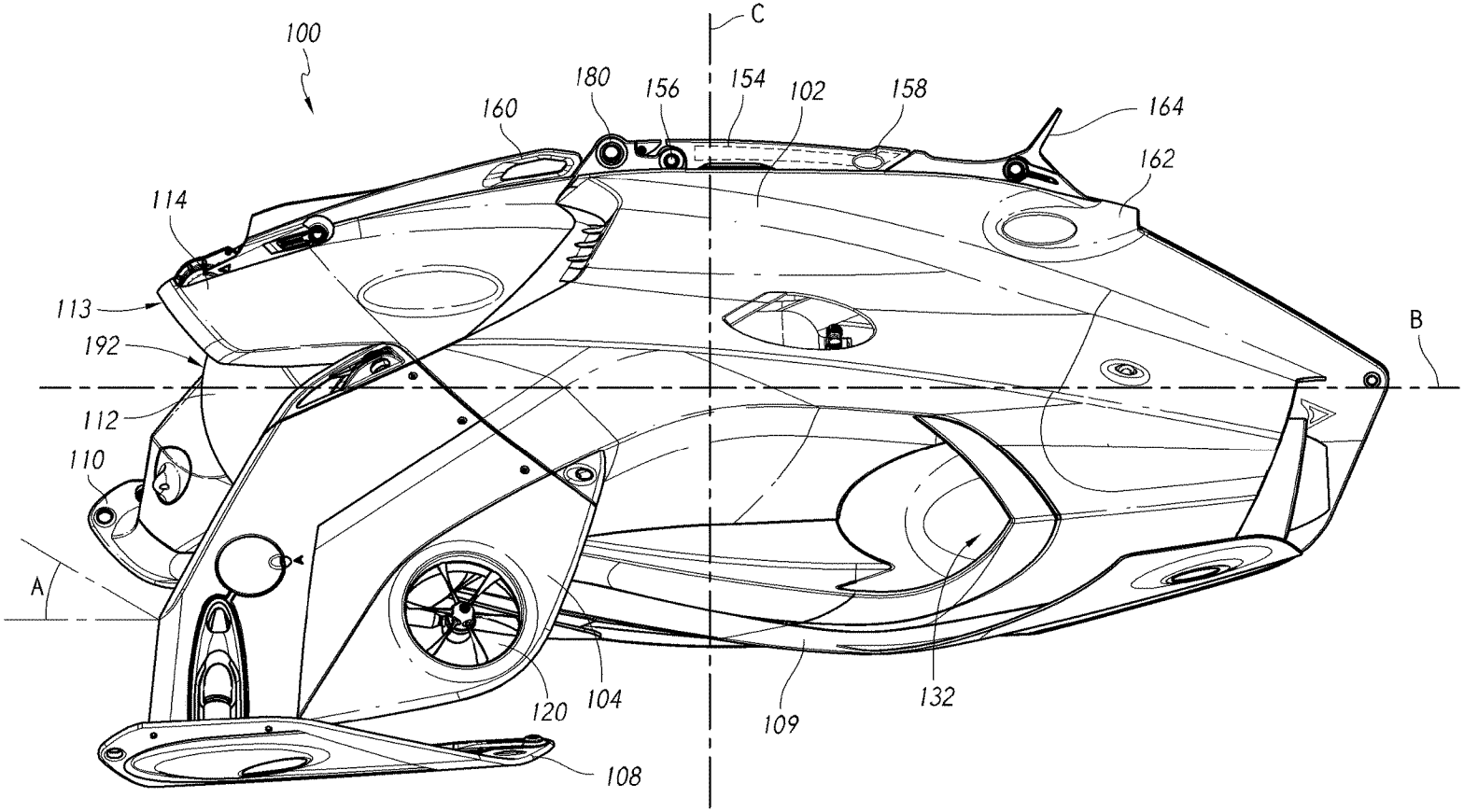
FIG. 1 is a left side view of an underwater personal submersible according to a preferred embodiment of the invention.
Figure 2:
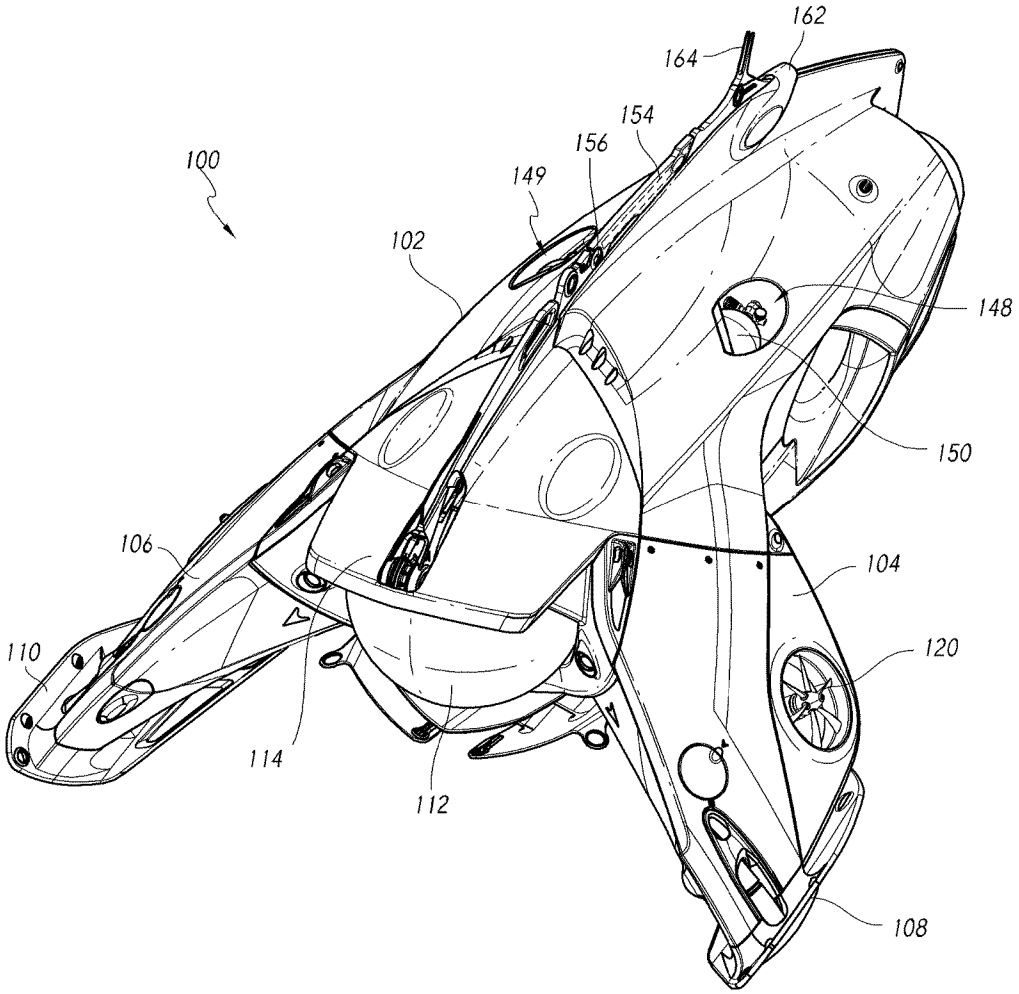
FIG. 2 is a perspective front left view of the top of an underwater personal submersible.

Referring to FIGS. 1-6, the personal submersible 100 preferably includes the main section 102. As shown most clearly in FIG. 5, the main section may comprise a user compartment 116 including an observation chamber 112, oxygen tanks 150, buoyancy bags 188, 190 (FIG. 9), a battery compartment 196, and a propulsion mechanism such as thrusters 136, 138, among other features. The user compartment 116 is desirably a pressurized compartment that may be sealed to prevent water intrusion when the submersible is underwater. The main section 102 may further include an observation chamber 112. The observation chamber 112 may be defined by a viewing portion 192 (FIG. 1). The viewing portion 192 is desirably a clear or transparent hemisphere that allows observation of the surrounding environment, including the environment directly below the forward portion of the submersible 100. The observation chamber 112 is desirably a portion of the user compartment 116 configured to allow the user's head and shoulders to move freely to facilitate the control and operation of the submersible 100. A visor 113 is desirably a defined by a leading edge of the hatch 114. The visor 113 is located directly above the viewing portion 192 of the observation chamber 112. Desirably, the user has an approximately 180 degree view side to side of the external environment through the viewing portion of the observation chamber. Also desirably, the user has an approximately 150 degree view up and down through the viewing portion of the observation chamber. Desirably, the user 118 has a viewing angle of the external environment that is substantially unobstructed and preferably not obstructed by any part of the submersible 100 (an "open viewing angle"). This configuration desirably allows the user to see both side to side as well as forward and directly underneath his or her position within the observation chamber.

In some embodiments, including the illustrated embodiment, a user horizontal, user vertical, or user operational open viewing angle may be measured from the center of the observation chamber 112 corresponding to where the user's eyes are expected to be positioned when the user is within the observation chamber 112 in an operating position. In other embodiments, including the illustrated embodiment, an observation chamber horizontal, observation chamber vertical, or observation chamber operational open viewing angle may be measured from the point where the front of the observation chamber 112 intersects the longitudinal axis B defined by the body of the submersible 100.

The user horizontal open viewing angle may be measured from the center of the observation chamber 112 corresponding to where the user's eyes are expected to be positioned when the user 118 is within the observation chamber 112 in an operating position. The user horizontal open viewing angle is parallel to a horizontal support surface upon which the submersible 100 rests. In some embodiments, including the illustrated embodiment, the user horizontal open viewing angle may be at least 45 degrees, more desirably at least 90 degrees, and most desirably at least 135 degrees. The observation chamber horizontal open viewing angle may be measured from the point where the front of the observation chamber 112 intersects the longitudinal axis B defined by the body of the submersible 100. The observation chamber horizontal open viewing angle is parallel to the horizontal support surface upon which the submersible 100 rests. In some embodiments, including the illustrated embodiment, the observation chamber horizontal open viewing angle may be at least 45 degrees, more desirably at least 90 degrees, and most desirably at least 150 degrees.

The user vertical open viewing angle may be measured from the center of the observation chamber 112 corresponding to where the user's eyes are expected to be positioned when the user 118 is within the observation chamber 112 in an operating position. The user vertical open viewing angle is perpendicular to a horizontal support surface upon which the submersible 100 rests. In some embodiments, including the illustrated embodiment, the user vertical open viewing angle may be at least 45 degrees, more desirably at least 90 degrees, and most desirably at least 135 degrees. The observation chamber vertical viewing angle may be measured from the point where the front of the observation chamber 112 intersects the longitudinal axis B defined by the body of the submersible 100. The observation chamber vertical viewing angle is perpendicular to a horizontal support surface upon which the submersible 100 rests. In some embodiments, including the illustrated embodiment, the observation chamber vertical open viewing angle may be at least 45 degrees, more desirably at least 90 degrees, and most desirably at least 150 degrees.

The user operational open viewing angle may be measured from the center of the observation chamber 112 corresponding to where the user's eyes are expected to be positioned when the user 118 is within the observation chamber 112 in an operating position. The user operational open viewing angle is perpendicular to the centerline of the user compartment 116 and/or the axis of the user's body when the user 118 in the user compartment 116 in an operating position. In some embodiments, including the illustrated embodiment, the user horizontal open viewing angle may be at least 45 degrees, more desirably at least 90 degrees, and most desirably at least 135 degrees. The observation chamber operational open viewing angle may be measured from the point where the front of the observation chamber 112 intersects the longitudinal axis B defined by the body of the submersible 100. The observation chamber operational open viewing angle is perpendicular to the centerline of the user compartment 116 and/or the axis of the user's body when the user 118 in the user compartment 116 in an operating position. In some embodiments, including the illustrated embodiment, the observation chamber horizontal open viewing angle may be at least 45 degrees, more desirably at least 90 degrees, and most desirably at least 150 degrees.

Advantageously, when the user 118 is within the user compartment 116, the observation chamber 112 provides a comfortable chamber from which to view the surrounding underwater environment in forward, peripheral, and downward directions. Furthermore, the observation chamber 112 desirably is of a size and shape such that it provides the additional advantage of allowing the user 118 greater freedom of movement to view the surrounding environment by turning his or her head from side to side within the observation chamber 112. The pressurized user compartment 116 is desirably shaped to allow the user 118 to extend his or her arms out and to the front within the compartment 116, as shown most clearly in FIGS. 5 and 8. In this position, the user 118 is in a natural, "flying" position and can intuitively control the device using fly-by-wire multidirectional hand controls such as joysticks located within the user compartment 116. To reduce weight, the user compartment 116 is preferably sized to eliminate dead and non-functional space and in some embodiments is sized for an average adult male, though other embodiments may size the user compartment 116 for an average adult female or an average child. In some embodiments, including the illustrated embodiment, the pressurized user compartment 116 can be configured to have a volume between approximately 200 liters and 800 liters, more desirably between 300 liters and 700 liters, and even more desirably between 350 liters and 600 liters.

Figure 17:
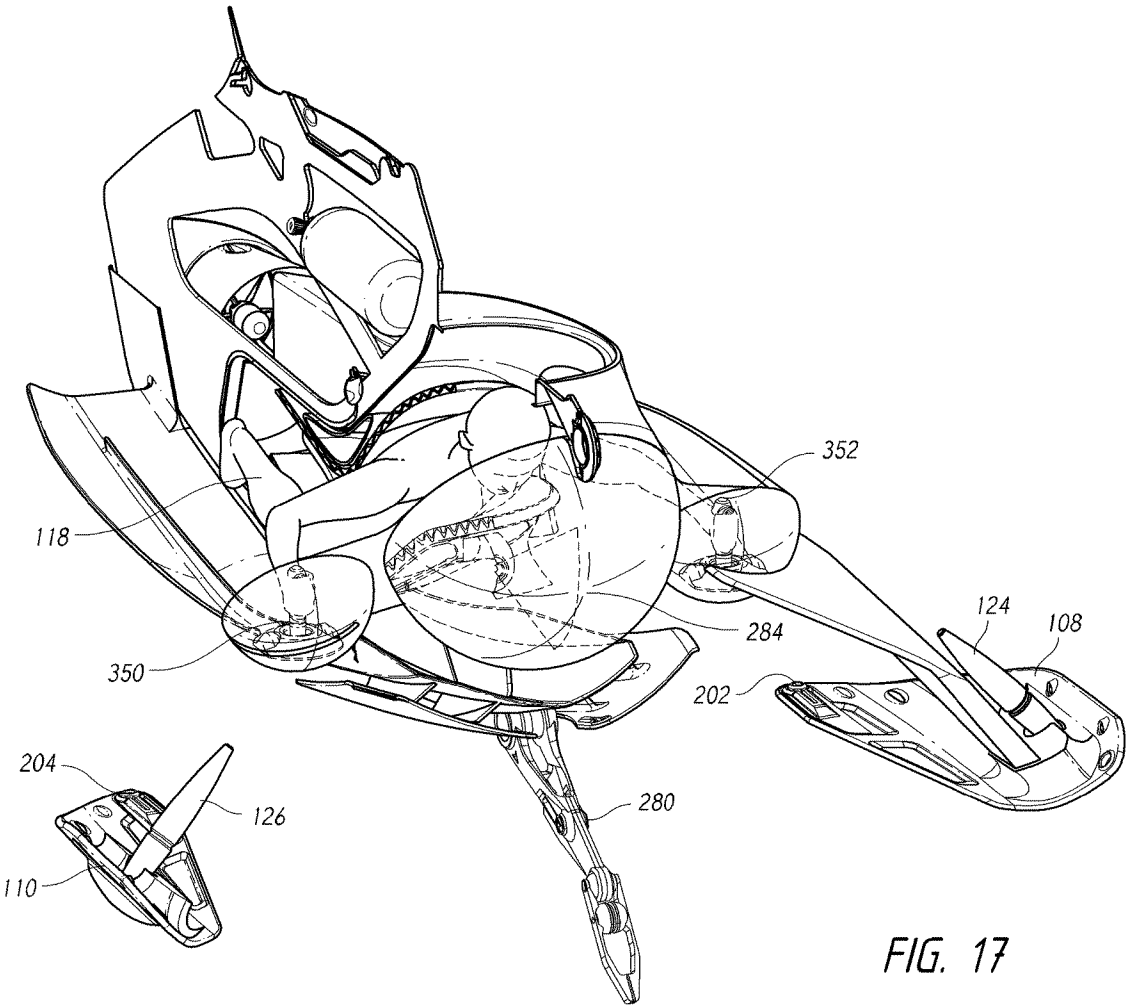
FIG. 17 is a partial perspective front right view of an underwater personal submersible and a user thereof.

Observation chamber 112 of the user compartment 116 may further comprise an instrument display 284 oriented to face the user 118 when the user 118 is within the user compartment 116 as shown in FIG. 17. The instrument display may indicate statistics related to the use of the submersible 100, including but not limited to the amount of oxygen remaining, current depth, maximum depth, current time, water temperature, speed, duration of the current dive, GPS coordinates, etc. Desirably, in some embodiments, the instrument display 284 is projected onto an interior surface of the viewing portion 192 similar to a heads-up display, as shown in FIG. 17. Projection of the instrument display 284 on the interior surface of the viewing portion 192 allows the user 118 to view statistics related to operation of the submersible 100 without requiring the user 118 to look away from the external environment. The user 118 can therefore remain focused on objects outside the submersible 100 without having to look away from the viewing portion 192 to manipulate a control mechanism such as a joystick.

Figure 14:
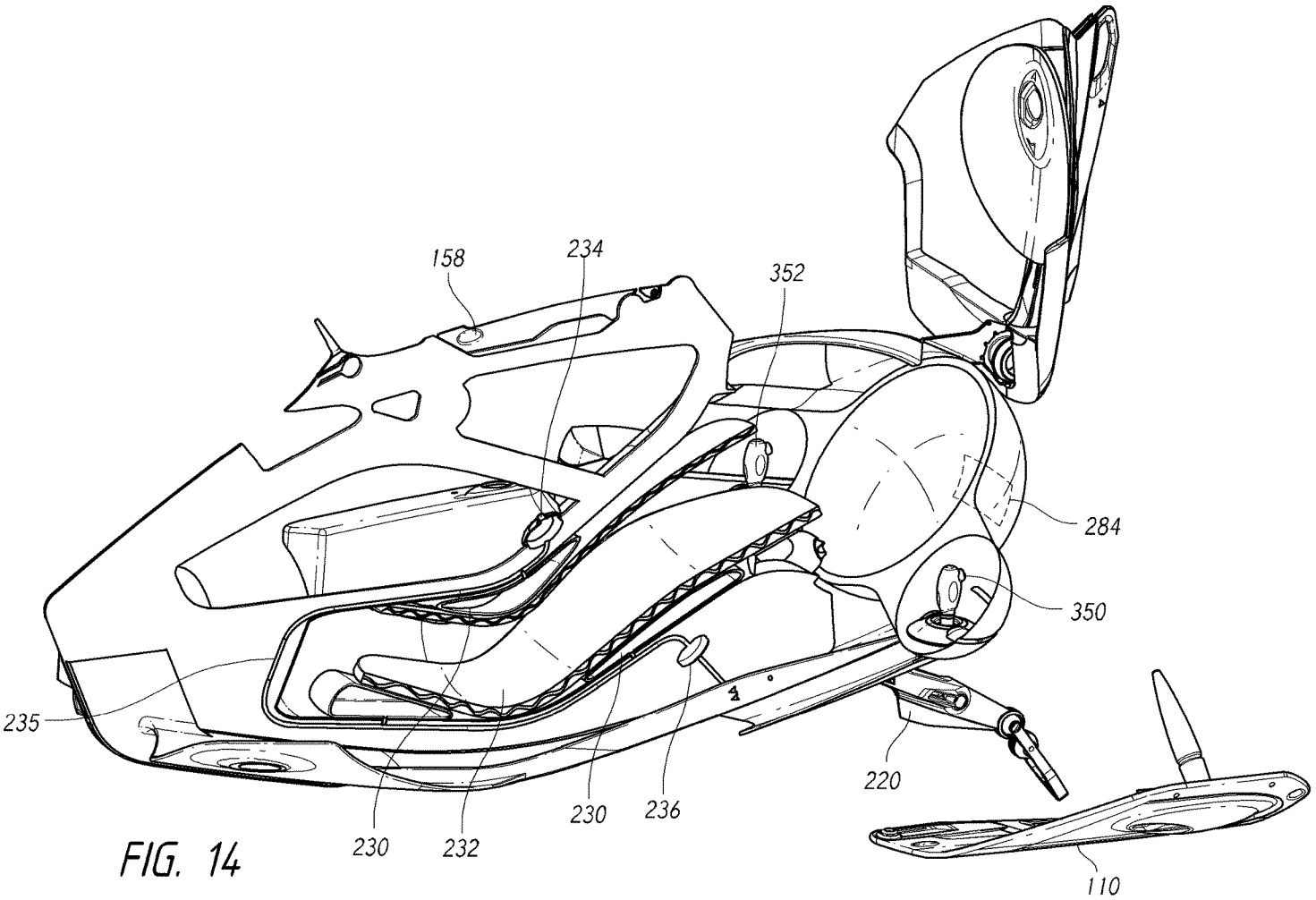
FIG. 14 is a partial perspective rear right view of a user compartment of an underwater personal submersible, including a heads up display projection.

As shown in FIGS. 14 and 17, the user compartment 116 may include a right controller 350 and a left controller 352. As shown, the controllers 350, 352 may be joysticks that can be easily manipulated by a user 118 within the user compartment 116. The controllers 350, 352 may be symmetrically placed within the user compartment 116 such that the user 118 can manipulate the controllers 350, 352 while in a semi-prone position within the user compartment 116 with the user's arms extended outward and to the front of his or her body. Desirably, the position of the controllers 350, 352 mimics the symmetrical orientation of the left and right support members 108, 110. More desirably, the controllers 350, 352 are oriented such that they are a natural extension of the user's unfolded arms. Desirably, this placement of the controllers 350, 352 results in an ergonomic control of the submersible 100. Furthermore, the user 116 desirably can manipulate the controllers 350, 352 while observing instrument or other data projected on the instrument display 284, as discussed above.

In some embodiments, including the illustrated embodiment shown in FIG. 14, the right controller 350 may control the overall maneuverability of the submersible 100 while the left controller 352 may control a manipulator arm 280 or other external component of the submersible 100. In other embodiments, the left controller 352 may control the overall maneuverability of the submersible 100 while the right controller 350 may control the a manipulator arm or other external component of the submersible 100, depending on the user's preference or left- or right-handedness. Desirably, the user 118 can remotely control the manipulator arm 280 using information displayed in the user's natural forward vision angle by the instrument display or heads up display (HUD) 284. Information may be graphically and textually displayed on an interior surface of the observation chamber 112 in the display 284 such that the user 118 does not need to turn his or her head to view information on physical gauges or dials that may be located below his or her line of vision. This allows the user 118 to retain a clear view of the external environment around the submersible 100 while operating external devices such as the manipulator arm 280.

Figure 4:
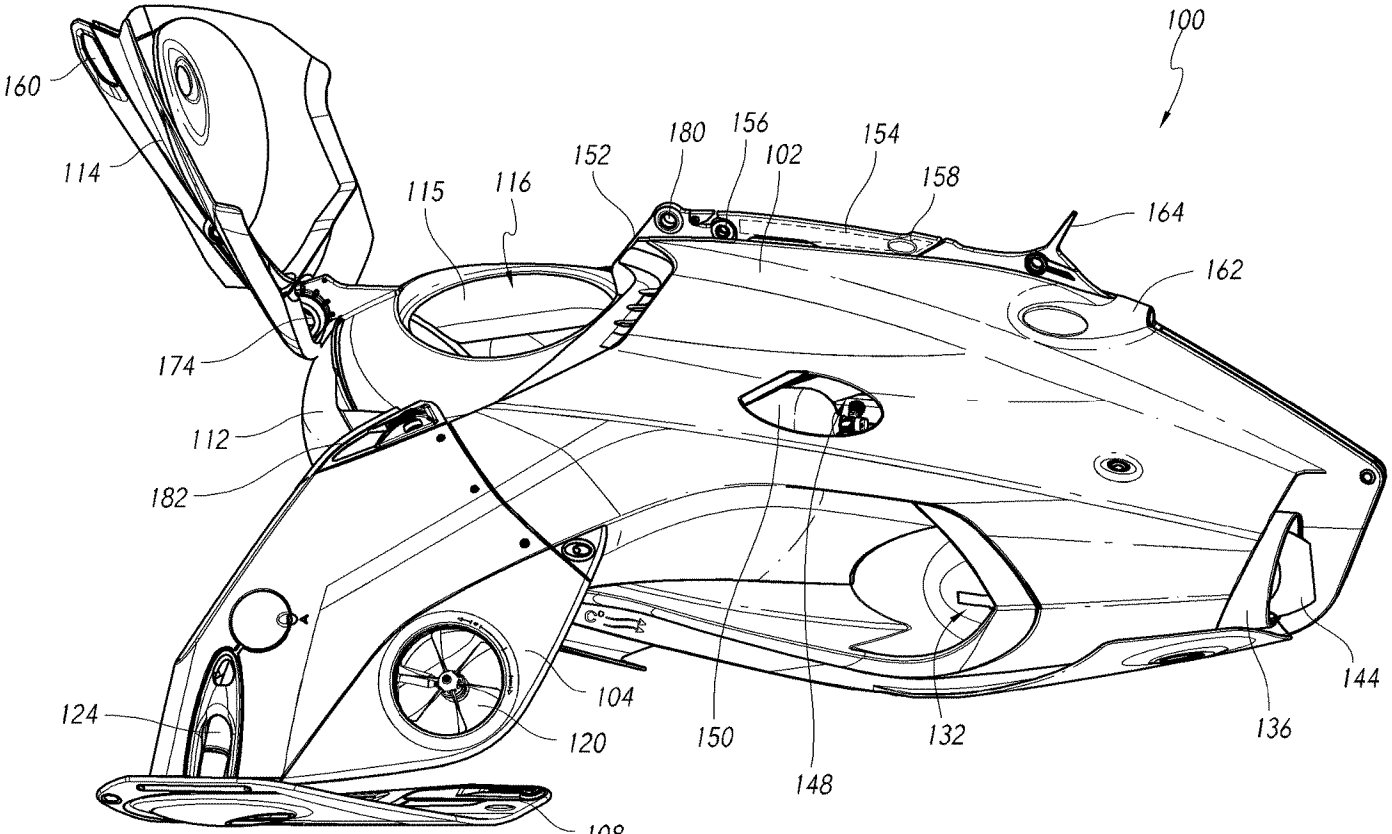
FIG. 4 is a second left side view of an underwater personal submersible with the hatch open.
Figure 15:
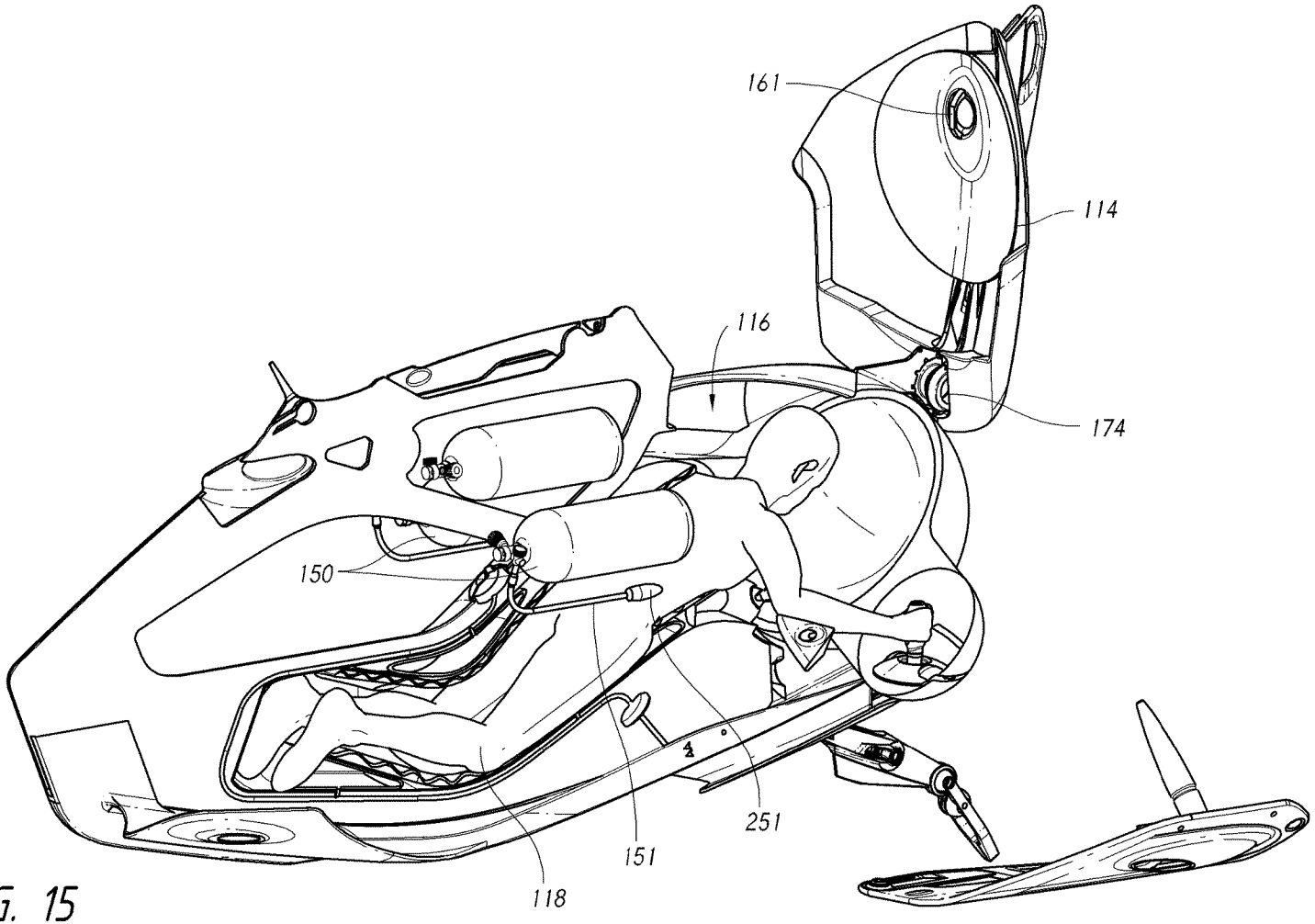
FIG. 15 is a second partial perspective rear right view of a user compartment of an underwater personal submersible including a user thereof within the user compartment.

Access to the user compartment 116 is desirably achieved by opening a hatch 114 located on the upper surface of the main section 102 and entering an opening 117, as shown most clearly in FIG. 4. The opening 117 in the upper surface of the main section 102 may be defined by a hatch flange 115 against which the hatch 114 seals when closed. Preferably, the opening 117 is sized to allow an average adult male to enter the user compartment 116 of the submersible 100. In some embodiments, including the illustrated embodiment, the opening 117 is desirably approximately circular. The hatch 114 is desirably rotatably connected to the main section 102 via a hatch linkage 174. The hatch linkage 174 is desirably located forward of the user compartment 116 to free up space within the user compartment 116 and offer a clear viewing angle into the user compartment 116 when the user 118 is outside the submersible 100 and preparing to enter the submersible 100 feet first. The hatch 114 is desirably configured to rotate about an axis defined by the hatch linkage 174 such that in an open position, the hatch 114 allows easy access to the user compartment 116. In the closed position, the hatch 114 seals against the hatch flange 115 such that the user compartment 116 may be pressurized and to prevent water from leaking into the user compartment 116. The hatch linkage 174 may be spring loaded such that the hatch 114 is urged into a closed and sealed position against the hatch flange 115. The hatch 114 may open at least 90 degrees, at least 115 degrees, or at least 130 degrees from the closed position. A hatch opening handle 160 is desirably provided on the top external surface of the hatch 114 to allow the hatch 114 to be opened from outside the user compartment 116. Additionally, as shown in FIG. 15, a user release handle 161 may be located on the inside of the hatch 114 or within the user compartment 116 such that the user 118 can open the hatch 114 from inside the user compartment 116. To open the hatch 114 from the inside, the user 118 grabs the user release handle 161 and rotates the handle 90 degrees. The tripod structure of the submersible 100 desirably allows the hatch 114 to be located well above the surface of the water when buoyancy bags on the submersible 100 are full and the submersible 100 is fully buoyant. Opening the hatch 114 when the submersible 100 is fully buoyant in the water allows the user 118 to enter and exit the submersible 100 without entering the water.

The user compartment 116 shown most clearly in FIG. 5 may further include at least an oxygen sensor or a carbon dioxide sensor. An oxygen transfer conduit 151, as shown most clearly in FIG. 15, preferably connects the user compartment 116 and one or more oxygen tanks 150 to provide breathable air to the observation chamber 112 and user compartment 116. Pneumatic valves, such as valve 251 (FIG. 15), can be controlled by the user 118 from within the user compartment 116 to regulate the flow of oxygen to the user compartment 116.

In some embodiments, including the illustrated embodiment, the oxygen transfer conduit 151 also passes through the chassis 172. Air exhaled by the user 118 may be released from the user compartment 116 to the external environment via an exit valve 152 (FIG. 4). Desirably, the exit valve 152 is permitted to release exhaled air and carbon dioxide from the user compartment 116 without allowing an influx of water.

Dead space, defined as empty space filled with air within the user compartment 116, can increase the weight of the submersible 100. As shown in FIG. 14, to reduce this dead space, the user compartment 116 may include a plurality of inflatable membranes such as bags or pillows 230 that define a plurality of inflatable chambers within the user compartment 116 to provide both cushioning for the user 118 and to fill up space within the user compartment 116 not occupied by the user's body. The inflatable bags 230 may be filled with ballast such as a saline solution gel, salt water, or other substance via an inflation mechanism 234 such as a hydraulic pump system. In some embodiments, the inflation mechanism 234 can draw salt or fresh water from outside the submersible 100 into the inflatable bags 230 via a conduit 235. Once the user 118 has entered the user compartment 116, the user 118 can activate the inflation mechanism 234 on each bag 230, causing the bags 230 to inflate and occupy a greater volume of the user compartment 116. The user 118 can manually adjust the level of inflation of the inflatable bags 230 to optimize the user's comfort and support. In some embodiments, including the illustrated embodiment, the inflatable chambers can occupy at least about 20%, at least about 30%, at least about 40%, at least about 50%, at least about 60%, or at least about 70% of the volume of the user compartment 116.

Additionally, another cushioning layer 232, such as a memory foam, may be provided to increase the user's comfort. The cushioning layer 232 and the inflatable bags 230 support the user 118 in a semi-prone, ergonomic position within the user compartment 116. The inflation of the bags 230, along with the cushioning member 232, reduce the overall volume of air within the user compartment 116 and allow the submersible 100 to obtain further negative buoyancy and descend in the water. To reduce the volume of solution or salt water within the bags 230, an exit mechanism 236 may be actuated to expel the solution or salt water to the surrounding environment. In some embodiments, the exit mechanism 236 may be a vacuum system. Desirably, this allows the user compartment 116 to regain the full air volume capacity and additionally provides positive buoyancy for the submersible 100, causing the submersible 100 to ascend in the water. Thus, the inflatable bags 230 can act as a complementary or secondary ballast system to the main ballast system shown in greater detail in FIG. 16 and discussed in greater detail below. In some embodiments, the volume of the inflatable bags 230 is approximately 100 liters.

As shown most clearly in FIGS. 4-8, three oxygen tanks are desirably located above the user compartment 116 within the main section 102. In other embodiments, less than three oxygen tanks 150 may be included. In other embodiments, more than three oxygen tanks 150 may be included. The oxygen tanks 150 may be accessed from outside the submersible 100 via oxygen tank access openings 148, 149 in the main section 102. The left oxygen tank access opening 148 is desirably located on the left side of the submersible 100. Similarly, the right oxygen tank access opening 149 is desirably located on the right side of the submersible 100. The oxygen tank access openings 148, 149 are desirably sized such that the oxygen tanks 150 may be removed, replaced, or serviced from outside the submersible 100.

In some embodiments, including the illustrated embodiment, the amount of air contained within the observation chamber 112 and the user compartment 116 may remain the same at all times. Furthermore, in some embodiments, including the illustrated embodiment, the constant flow of air preferably maintains a mix of carbon dioxide and oxygen to ensure a proper, breathable mixture is maintained for the user 118.

In some embodiments, including the illustrated embodiment, the main section 102 may further include a snorkel 154. The snorkel 154 is preferably fluidly connected to the observation chamber 112 to provide breathable air to the observation chamber 112 while the submersible 112 is out of the water or prior to a diving operation. The snorkel 154 also provides a conduit for air exhaled by the user 118. The bubbles rising from the snorkel 154 may provide an additional indication of the underwater location of the submersible 100. The snorkel 154 is desirably rotatably connected to the main section 102 via anchor point 156. The snorkel 154 may further include a floater 158 to allow the snorkel 154 to extend upwards from the main section 102 in an approximately 90 degree angle from the upper surface of the main section 102. When deployed through flotation of the floater 158, air from above the surface of the water can enter the user compartment 116 via the snorkel 154. The oxygen level within the user compartment 116 can therefore be stabilized without diminishing the oxygen tank supplies while the submersible 100 is at or near the surface of the water.

With continued reference to FIGS. 1-6, the main section 102 is desirably provided with scanning and acquisition sensors. For example, in some embodiments, including the illustrated embodiment, the submersible 100 can be equipped with at least one scanner and/or at least one sensor. The scanner and acquisition sensor 162 may be located on the upper surface of the main section 102, as shown most clearly in FIG. 1. During use, therefore, in addition to allowing a user 118 to discover a reef or other underwater feature, in some embodiments, including the illustrated embodiment, the submersible 100 can also gather data about the ocean and ocean life, including for example, water quality, the temperature of the currents, the density of plankton and bacteria, the acidity of the water, or the status of photosynthesis in the coral reef. Without any effort or particular focus, the user 118 can gather information which can then be stored or directly transferred via a data transmitter 164 to a common server via the internet and become accessible by researchers around the world. The scanner can define and record a 3D map of the underwater feature and its movement in deep and shallow water. In accordance with some embodiments, including the illustrated embodiment, scanned and acquired information can be transferred either automatically or manually to provide an updated 3D map of the bottom of the sea, as well as conditions of the ocean and ocean life. Other various sensors can be incorporated into the unit as desired. It is contemplated that an open source for oceanic data may become crucial and in demand by marine biologists around the world.

In some embodiments, including the illustrated embodiment, attached to the main section 102 are two forwardly-extending stabilizing surfaces or "wings." The left wing 104 attaches to the left side of the main section 102 at line 302 (FIG. 6) and the right wing 106 attaches to the right side of the main section 102 at line 304 (FIG. 6). The left wing 104, right wing 106, and main section 102 form a "tripod" architecture that fits the user's downward-facing posture, allowing the user 118 an intuitive feeling of flying while operating the submersible 100. Additionally, the left wing 104, right wing 106, and main section 102 form a tripod support structure for the submersible 100 such that when the submersible 100 is resting on the ground or the underwater surface such as the floor of the ocean, the submersible 100 has three points of contact with the ground or underwater surface. As shown in FIG. 12, these three points of contact desirably include the left support member or ski 108 attached bottom of the left wing 104, the right support member or ski 110 attached to the bottom of the right wing 106, and the center support member or ski 109 attached to the bottom of the main section 102. Each ski 108, 109, 110 desirably provides a relatively large, preferably flat contact surface with the ground in order to evenly distribute the weight of the submersible 100 to avoid sinking or trapping the submersible 100 in sand or damaging a boat dock or platform from which the submersible 100 is launched. For purposes of this application, a contact surface is preferably calculated as the amount of surface area of each ski which would contact a horizontal surface when the submersible is resting thereon. For example, each ski desirably defines a contact area of at least 3 square feet, at least 4 square feet, or at least 6 square feet.

The skis 108, 109, 110 are preferably configured with an "L" shape to allow for a small footprint on unstable ground such as sand. The shape of the skis 108, 109, 110 also allow for a stable support of the submersible 100 when it is located on a more solid surface, such as the deck of a vessel. As shown in FIG. 13, from the front, the skis 108, 109, 110 enhance the hydrodynamic shape of the submersible 100 to reduce drag on the submersible 100 while it is at speed within the water.

Figure 7:
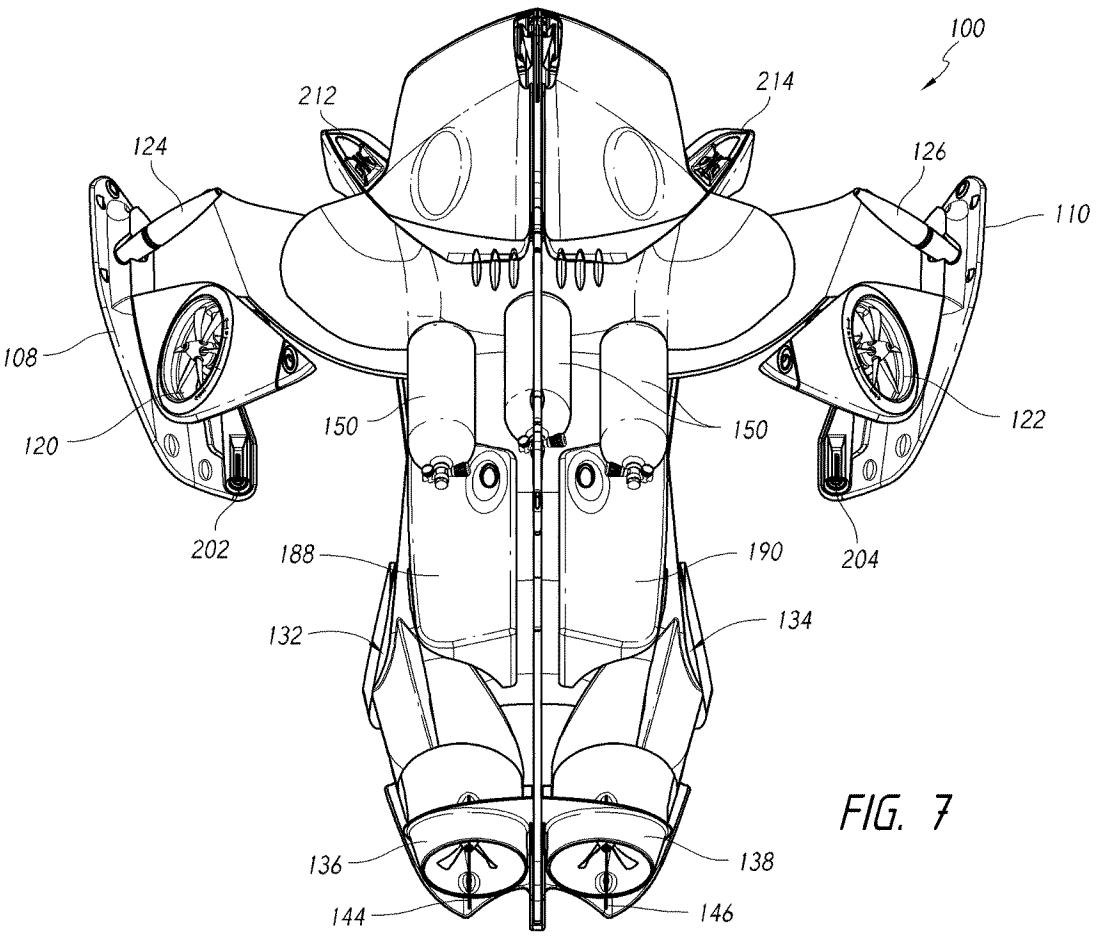
FIG. 7 is a partial top view of an underwater personal submersible.

The orientation and extension of the skis 108, 110 may be adjusted using left and right ski adjustment mechanisms 124, 126 (FIGS. 5, 7, and 17). The adjustment mechanisms 124, 126 may be configured as dampeners to absorb the impact of the submersible 100 landing on soft sand or the deck of a vessel. Left and right ski proximity sensors 176, 178 may be located on a lower surface of each ski to assist the user 118 in operating the submersible by providing information as to the proximity of rocks, coral, or other underwater hazards, or the bottom surface.

Additionally, the left and right skis 108, 110 are desirably configured with the main section 102 such that the forward edge of each ski extends beyond the front of the submersible 100, as shown most clearly in FIG. 1. By extending in front of the submersible 100, and particularly extending in front of the viewing portion 192 of the observation chamber 112, the left and right skis 108, 110, along with the visor 113, can protect the observation chamber 112 from impact damage while still allowing the user 118 to easily view the environment forward and below the user's position.

Desirably, the center ski 109 is integrated into the bottom surface of the main section 102. The center ski 109 may distribute the weight of the submersible 100 while it rests on wet sand or on a dock. In some embodiments, including the illustrated embodiment, the center ski 109 has a curved shape that follows the curvature of the bottom of the main section 102. The center ski 109 is preferably rigid to keep the submersible 100 stable while it is being transported and also while it is being lifted in and out of the water. The left ski 108 and the right ski 110 provide additional points of contact with the surface (wet sand, dock, boat deck, etc.) and allow the weight of the submersible 100 to be distributed between the three points of contact (left ski 108, right ski 110, and center ski 109) for increased stability. A center ski proximity sensor 170 (FIG. 5) may be located on the lower surface of the center ski 109 to further assist the user 118 in avoiding obstacles or hazards on the bottom surface during operation of the submersible 100.

As seen most clearly in FIG. 5, the main section 102 further comprises a battery compartment 196. The battery compartment 196 is desirably located below the user compartment 116 along the bottom of the main section 102. The flow of the surrounding water against the battery compartment 196 aids in dissipating heat generated by the batteries. The batteries may be used to power an instrument panel within the user compartment 116, thruster mechanisms 136, 138, stabilizer mechanisms such as thrusters 120, 122, or any other electrical system on the submersible 100. The batteries within the battery compartment 196 may also provide additional ballast or weight that may be used to keep the submersible 100 neutrally buoyant underwater, as will be discussed in greater detail below.

Figure 9:
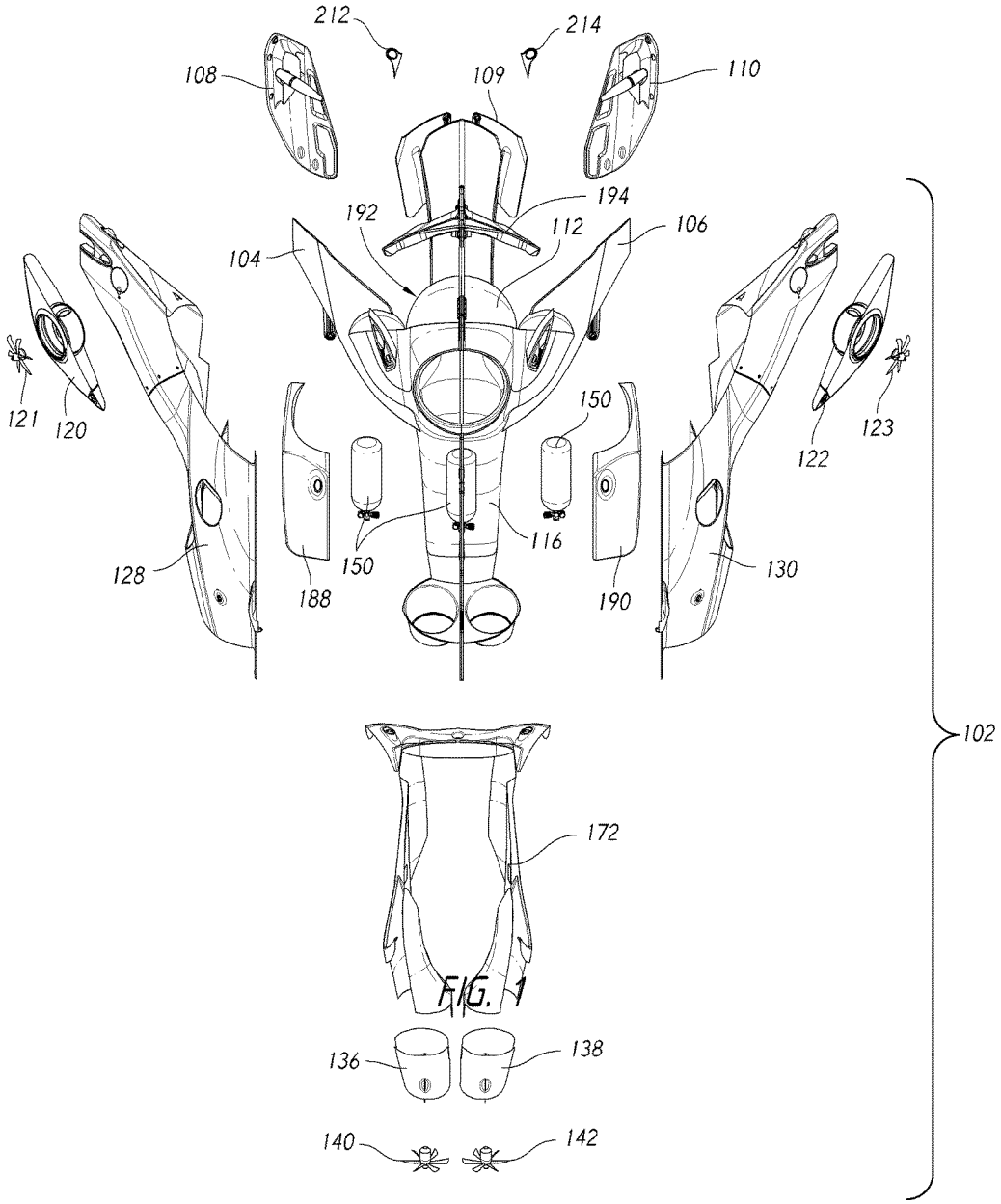
FIG. 9 is a top view of an exploded assembly of an underwater personal submersible according to a preferred embodiment of the invention.
Figure 18:
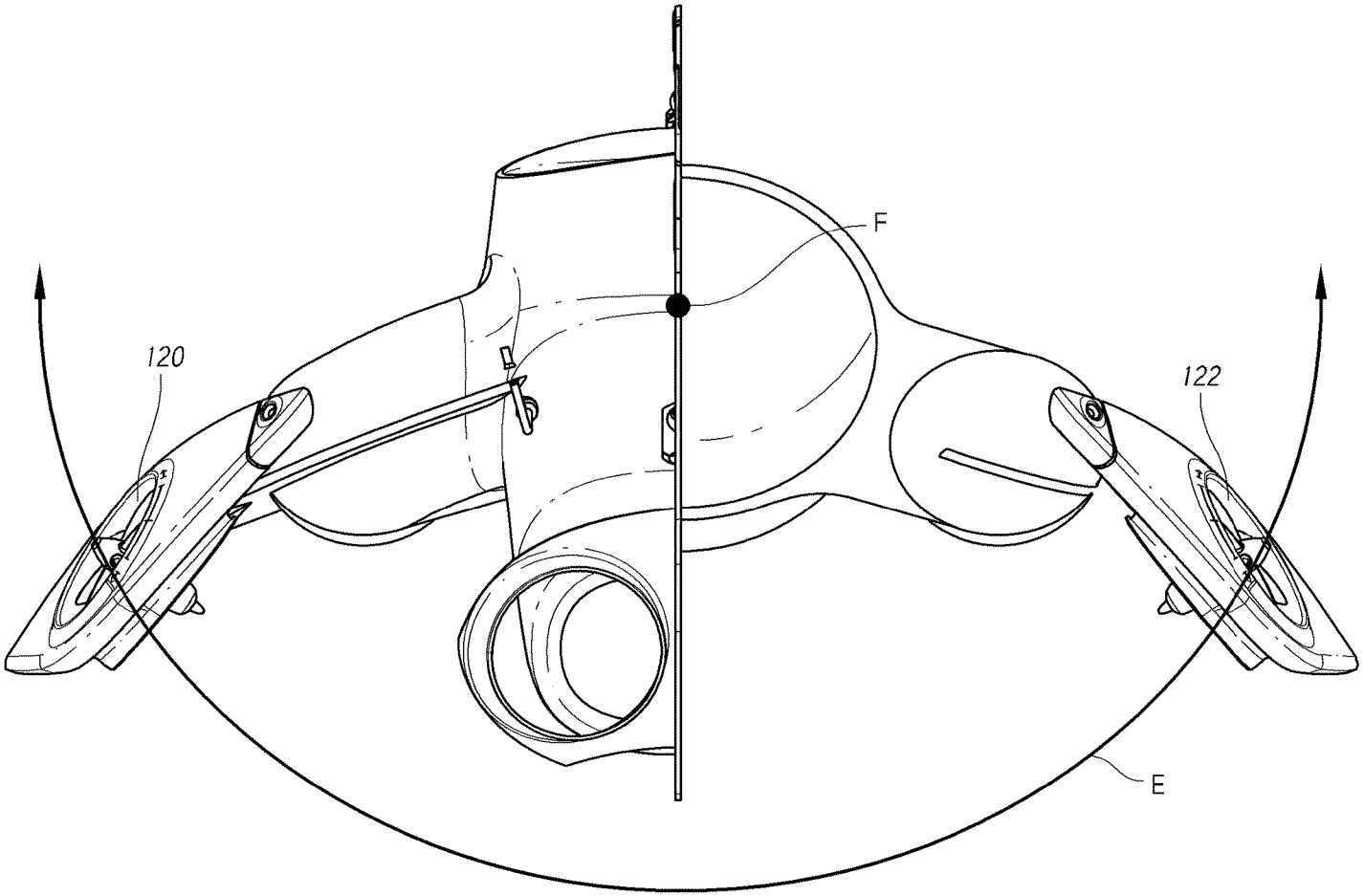
FIG. 18 is a partial rear view of an underwater personal submersible illustrating the maneuverability of the submersible via side stabilizers.

Integrated into the wings 104, 106, in some embodiments, including the illustrated embodiments shown in FIGS. 1-4 and 6-9, are vertical stabilizer mechanisms 120, 122. The vertical stabilizer mechanisms 120, 122 are oriented concentrically around the center of gravity and longitudinal axis B of the submersible 100, as shown most clearly in FIG. 6. The stabilizer mechanisms 120, 122 balance the underwater position of the submersible 100 by applying vertical forces to change the orientation of the submersible 100. Each stabilizer mechanism 120, 122 desirably includes a stabilizer propeller or other suitable thrust generating assembly. As shown in FIG. 9, the left stabilizer propeller 121 rotates within the left stabilizer mechanism 120 located on the left wing 104 and the right stabilizer propeller 123 rotates within the left stabilizer mechanism 122 located on the right wing 106. Desirably, the propellers 121, 123 may rotate in either direction. The attitude or longitudinal angle of the front of the submersible 100 relative to the horizontal as viewed from the side of the submersible 100 (see angle A shown on FIG. 1) may be adjusted by rotating the propellers 121, 123 in the same direction. Rotation of the propellers 121, 123 in opposite directions will tilt the submersible 100 left and right about an axis defined by the main body of the submersible 100 and passing through the center of gravity F of the main section 102 (FIG. 18) such that the stabilizers 120, 122 of the submersible 100 move along arc E (FIG. 18). When operated in conjunction with a forward propulsion system, the stabilizer mechanisms 120, 122 allow the user 118 to control the direction of movement of the submersible 100 via fly-by-wire controls located within the user compartment 116. Due to the concentric placement of the stabilizer mechanisms 120, 122, the submersible 100 is desirably highly maneuverable. In some embodiments, including the illustrated embodiment, the submersible 100 may be able rotate about a central axis C (FIG. 1) extending vertically through the main section 102 such that the submersible 100 has a zero turning radius.

In some embodiments, the submersible 100 can reach a forward speed of at least 10 knots. At a forward speed of approximately 10 knots, the submersible 100 desirably can rotate up to 90 degrees in three dimensions around a longitudinal axis B defined through the middle of the submersible 100 as shown in FIG. 6.

Figure 19:
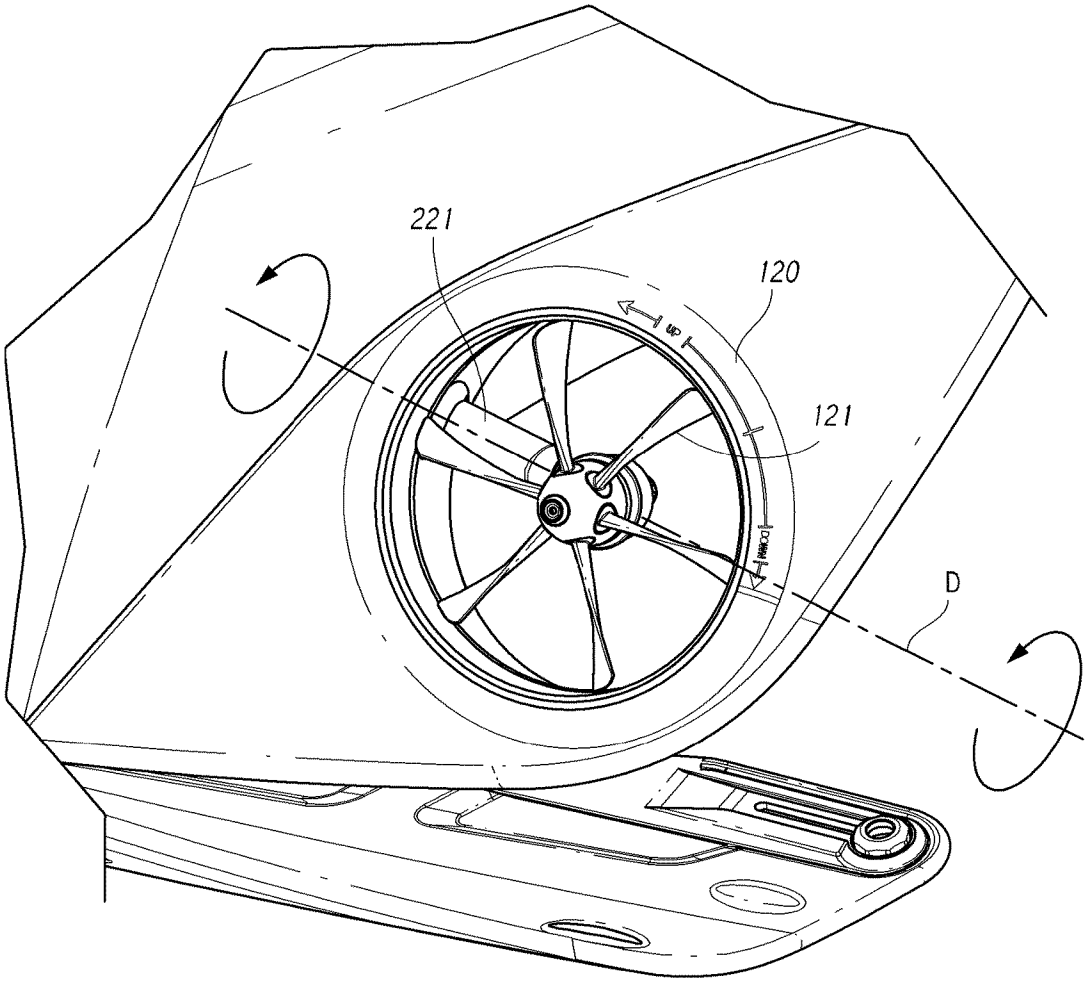
FIG. 19 is a detail view of one of the side stabilizers of an underwater personal submersible.

At low or zero forward speed, as illustrated in FIGS. 18 and 19, the left and right stabilizers 120, 122 provide upwards and downwards thrust by inversing the rotation of the left and right stabilizer propellers 121, 123. Furthermore, the propellers 121, 123 of the left and right stabilizers 120, 122 can rotate within the stabilizer mechanisms as shown in FIG. 19. For example, FIG. 19 illustrates the left stabilizer 120 and left propeller 121. The left propeller 121 can rotate up to 90 degrees about an axis D defined by a propeller rotation motor 121 such that the left propeller 121 can be oriented at different angles with respect to the plane of the left wing 104. The right propeller 123 can rotate in a similar way with respect to the plane of the right wing 106 (not shown). Rotation of the propellers 121, 123 with respect to the plane of the wings 104, 106 can cause the submersible 100 to move in a straight up (ascend) or straight down (descend) motion while remaining level within the water. This maneuverability is particularly desirable when the submersible 100 is towing or lifting equipment. Desirably, the stabilizers 120, 122 have a power of approximately 15-25 horsepower.

At higher speeds, right and left changes of direction may be achieved by moderating the thrust provided by the propulsion mechanism, as described below.

Figure 3:
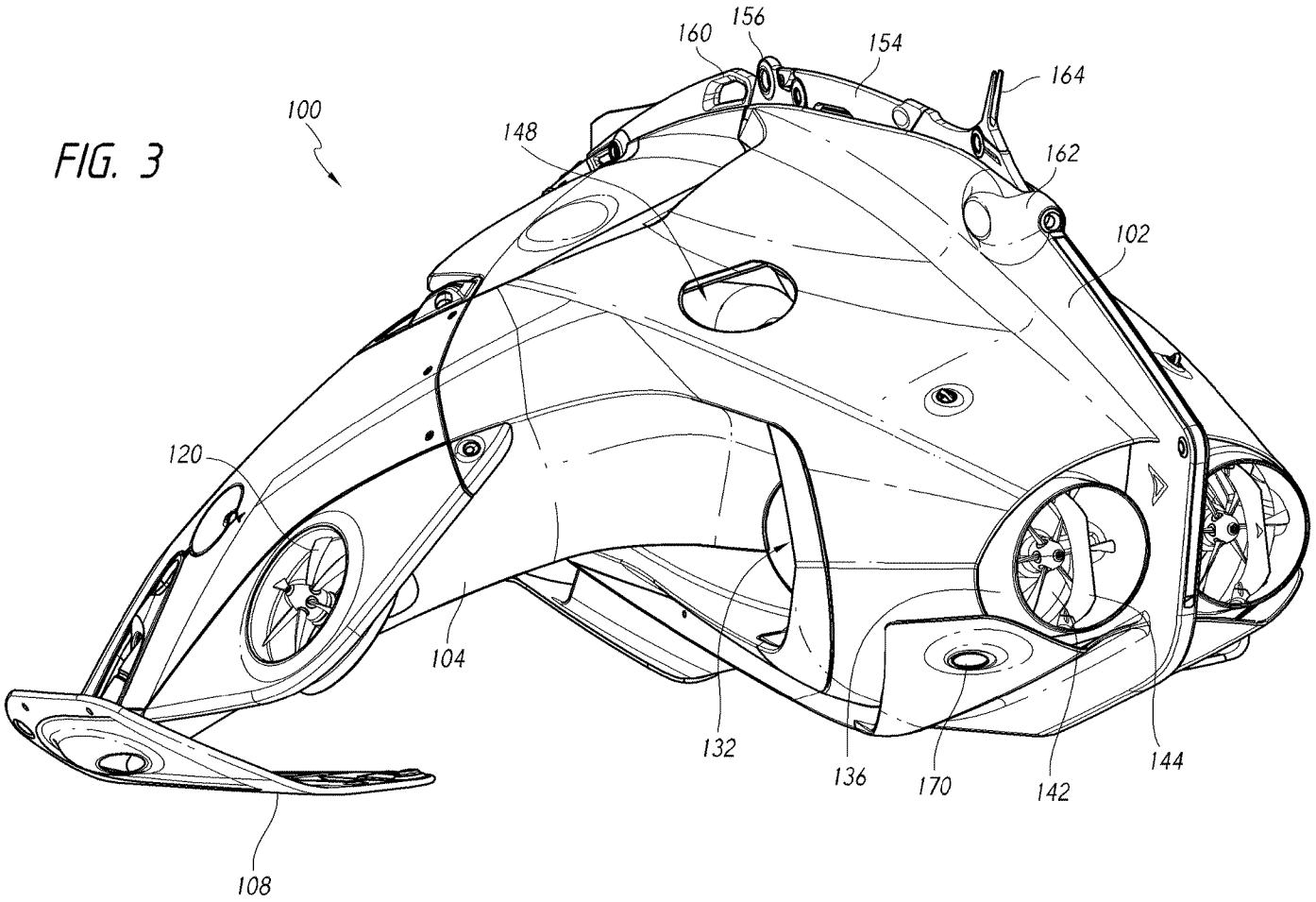
FIG. 3 is a perspective rear left view of an underwater personal submersible.

As shown most clearly in FIGS. 3 and 7, submersible 100 may further include a propulsion mechanism integrated into the submersible 100. In some embodiments, the propulsion mechanism may be integrated into the main section 102. In other embodiments, the propulsion mechanism may be integrated into the chassis 172. In some embodiments, including the illustrated embodiment, the propulsion mechanism desirably includes a pair of thruster mechanisms, such as a pair of water jet thruster mechanisms. Left thruster mechanism 136 is located on the left rear side of the main section 102 and right thruster mechanism 138 is located on the right rear side of the main section 102. Each thruster mechanism 136, 138 is desirably operatively connected to an electric motor in a housing connected via a shaft to a propeller 140, 142. The force applied by the motors on the propellers 140, 142, and the angle and location of the thruster mechanisms 136, 138 within the main section 102, desirably provides linear thrust to directly propel the submersible 100 in the desired direction. In one embodiment, as illustrated in FIGS. 3 and 6-8, each thruster mechanism 136, 138 may further include a steering mechanism 144, 146, such as a rudder, which may be mechanically or electrically connected to controls within the user compartment 116 so as to be controlled thereby to steer the submersible 100. In one embodiment, the thruster mechanisms 136, 138 may be enclosed within the main section 102, as illustrated in FIGS. 3 and 6-7. In other embodiments, the propulsion mechanism may be located on the wings 104, 106 or in any other suitable location.

The thruster mechanisms 136, 138 may be powered by electricity provided by one or more electric motors. Preferably, one or more 12 v, 24 v or 36 v electric motors may be integrated into the main section 102 and located above the back of the user 118. The electric motor or motors may be powered by batteries. The location of the batteries and the electric motor or motors can desirably be part of the weight equation resulting in the balance of the overall unit underwater. Power sources of other types (e.g., gasoline motors) with different power characteristics may also be used.

In some embodiments, including the illustrated embodiment, the thruster mechanisms 136, 138 may be water-jets, hydrojets, or pump jets comprising ducted propellers 140, 142 with nozzles. Water may be pulled into the thruster mechanisms via a water entry point located forward of each thruster mechanism to create a jet of water for propulsion. As shown in FIG. 7, the water entry point 132 directs water into left thruster mechanism 136 and water entry point 134 directs water into right thruster mechanism 138. As will be discussed in greater detail below, the main section 102 is hydrodynamically configured to direct water into the water entry points 132, 134 to feed the thruster mechanisms 136, 138. The water entry points 132, 134 act as intakes located on the bottom hull of the main section 102 to allow water to pass underneath the submersible 100 and into the thruster mechanisms 136, 138. The water pressure inside water entry points 132, 134 is increased by the pumping action of the propellers 140, 142 and the water is forced through the nozzles of the thruster mechanisms 136, 138. The thruster mechanisms 136, 138 also assist with steering the submersible 100. Steering mechanisms 144, 146 may be located within the nozzles of the thruster mechanisms 136, 138 in order to redirect the water flow. The steering mechanisms 144, 146 may be mechanically or electrically controlled via fly-by-wire or mechanical multidirectional joysticks in the user compartment 116. The thrusters 136, 138 may be switched on and off by manipulating either the right or left controllers 350, 352, as shown in FIGS. 14 and 17. An infrared transponder may be configured to command both thrusters 136, 138 and to vary the speed of rotation of the propellers 142, 144 within the thrusters 136, 138.

The thruster mechanisms 136, 138 provide many advantages over bare propellers including but not limited to: higher speed prior to cavitation, high power density, protection of the rotating element making operation of the submersible 100 safer around swimmers and aquatic life, improved shallow water operation, increased maneuverability, and reduced noise.

Figure 16:
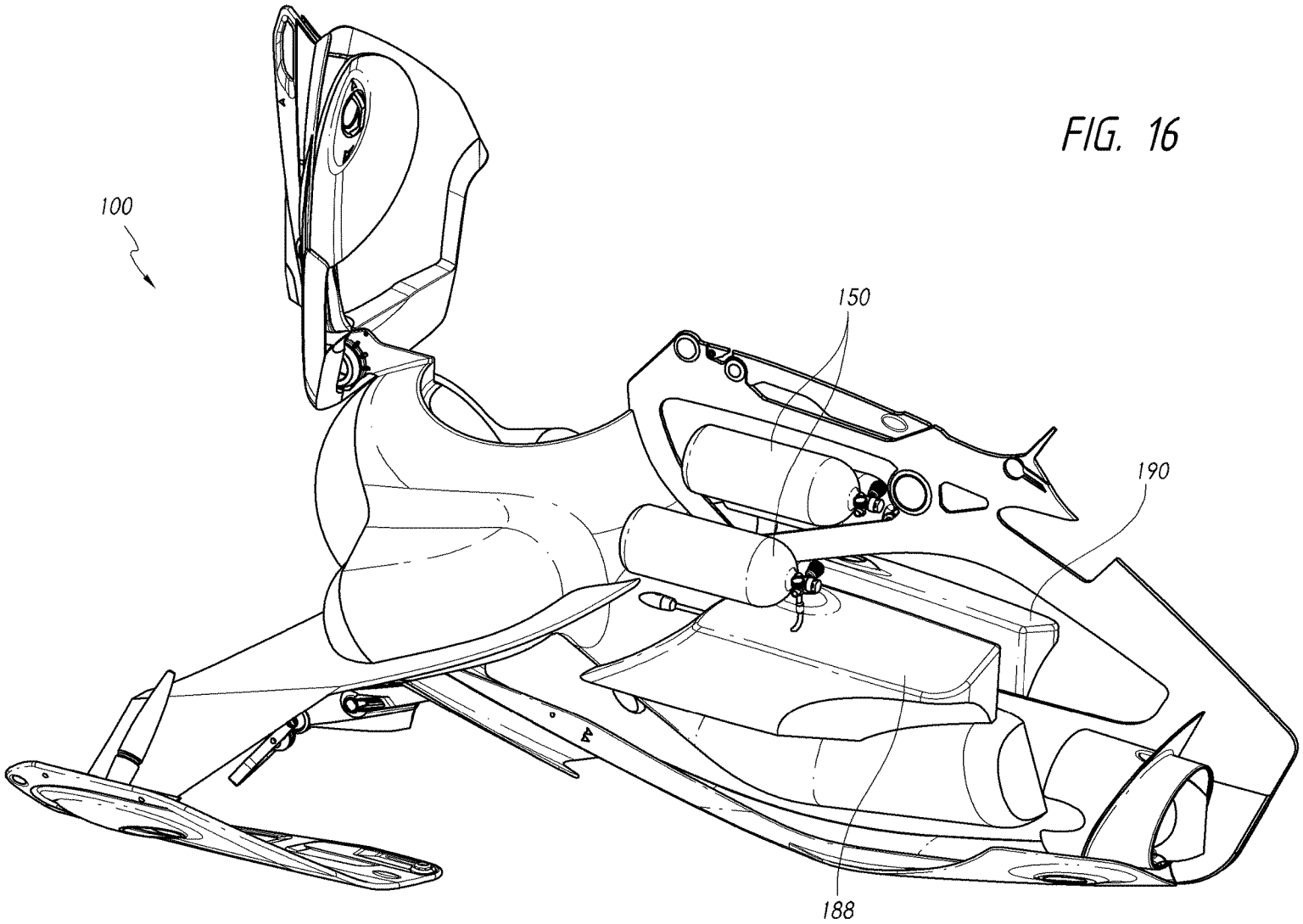
FIG. 16 is a second partial perspective rear left view of an underwater personal submersible illustrating one possible location of the buoyancy bags and oxygen tanks.

The buoyancy of the submersible 100 may be controlled by the user 118 during operation. FIG. 7 illustrates the positions, in one embodiment, of buoyancy bags 188, 190. Desirably, the main buoyancy system or system ballast bags 188, 190 provide a means for adjusting the buoyancy of the submersible 100. As also shown in FIG. 16, the buoyancy bags 188, 190 provide a means for adjusting the positive and negative buoyancy of the submersible 100 (that is, the force causing the submersible 100 to ascend or descend in the water). The oxygen tanks 150 desirably provide the main source of ballast or weight in the submersible 100. Other sources of ballast may also be used, such as weights. The buoyancy bags 188, 190 desirably have a volume of between about 50 liters to about 200 liters. Desirably, the submersible 100 has a total weight of approximately 2000 lbs.

Desirably, the buoyancy bags 188, 190 are located above the user compartment 116 and below the oxygen tanks 150 within the main section 102. The ballast area 189 may consist of a varied amount of weight, depending on the morphology of the user 118 and the specific purpose of use of the submersible 100 (e.g., shallow water operation or deep water operation). Similarly, the buoyancy bags 188, 190 may be inflated or deflated depending on the morphology of the user and the specific use of the device desired by the user 118 (e.g., accelerating or decelerating the rate of ascent or descent or achieving neutral buoyancy). Additionally, in some embodiments, including the illustrated embodiment, the level of inflation of the buoyancy bags 188, 190 may be controlled by the user 118 via controls located within the user compartment 116. In some embodiments, including the illustrated embodiment, the buoyancy bags 188, 190 are fluidly connected to one or more of the oxygen tanks 150 such that upon a user command to inflate the buoyancy bags 188, 190, oxygen flows from the one or more oxygen tanks 150 to one or both of the buoyancy bags 188, 190. Desirably, to maintain the balance and stability of the submersible 100 while underwater, the buoyancy bags 188, 190 are maintained at the same fill level (that is, oxygen is released and added to the buoyancy bags 188, 190 at the same rate). A pneumatic valve and conduit may connect one or more of the oxygen tanks 150 and the buoyancy bags 188, 190 to control the flow of oxygen into and out of the buoyancy bags 188, 190. The pneumatic valve may be actuated by a solenoid controlled by one of the user controllers 350, 352.

As discussed above, the submersible 100 may further include the battery compartment 196, as seen in FIG. 5. In some embodiments, including the illustrated embodiment, the battery compartment 196 may provide additional weight for inclusion in the calculation of neutral buoyancy of the submersible 100 when submerged underwater.

In some embodiments, including the illustrated embodiment, the submersible 100 may be provided with a number of attachment members to assist in transporting the submersible 100. The attachment members may also be used to tow equipment, objects, or other vehicles in the water or to lift equipment, objects, or other vehicles from the ocean or lake bottom. As most clearly seen in FIGS. 6-8, left front attachment member 212 and right front attachment member 214 may be located forward of the left and right wings 104, 106, respectively, at the intersection between the main section 102 and the left and right wings 104, 106. In some embodiments, the attachment members 212, 214 may be part of the chassis 172. In other embodiments, the attachment members 212, 214 may be part of the main section 102. Additionally, left rear attachment member 206 and right rear attachment member 208 are desirably located along the rear upper surface of the main section 102, forward of the thruster mechanisms 136, 138. The attachment members 206, 208, 212, 214 are desirably attached to the main section 102 in some embodiments. In other embodiments, the attachment members 206, 208 may be integrated into the chassis 172. The attachment members 206, 208, 212, 214 are desirably placed on the submersible 100 such that the weight of the submersible 100 when lifted is evenly distributed among the multiple attachment members 206, 208, 212, 214. In some embodiments, the attachment members 206, 208, 212, 214 may be configured such that a tow rope or cable may be attached to one or more of the attachment members 296, 208, 212, 214.

With continued reference to FIGS. 6-8, in some embodiments, including the illustrated embodiment, the submersible 100 may further include left and right ski attachment members 202, 204. The left ski attachment member 202 is desirably located at the rear or trailing edge of the left ski 108 and the right ski attachment member 204 is desirably located at the rear or trailing edge of the right ski 110. The left and right ski attachment members 202, 204 are desirably configured to tow or lift heavy equipment or objects from the ocean or lake bottom. As shown in FIG. 17, the manipulator arm 280 is attached to the bottom of the submersible 100 such that the user 118 can view the manipulating end of the arm 280 through the observation chamber 112. The manipulator arm 280 desirably has a three dimensional reach to secure or detach equipment or other items to the attachment points 202, 204 on the skis 180, 110 without external supervision. Desirably, the submersible 100 can tow a weight of approximately 500 lbs.

FIG. 9 depicts an exploded view of a preferred embodiment of the submersible 100. FIG. 10 depicts one embodiment of a chassis 172 and propulsion system for a submersible 100. Submersible 100 includes the main section 102 that, in the illustrated arrangement, is further comprised of an observation chamber 112 and a user compartment 116. As shown, the observation chamber 112 and the user compartment 116 form the majority of the main section 102 and may be supported, either directly or indirectly, by a chassis 172. In other embodiments, the submersible 100 does not include a separate chassis 172. The viewing portion 192 of the observation chamber 112 may be formed from a clear or "see through" material, such as acrylic, allowing the user to view the surrounding environment while underwater. As seen most clearly in FIG. 9, this viewing portion 192 may, in some embodiments, including the illustrated embodiment, be shaped substantially as a hemisphere allowing the user 118 a greater range of vision and may be attached to the main section, as in the present embodiment, with a curved viewing attachment piece 194 (FIG. 4). The viewing attachment piece 194 preferably wraps around the circumference of the viewing portion 192 in order to seal the edges where the viewing portion 192 meets the main section 102 in order to substantially prevent the intrusion of water into the user compartment 116 and the observation chamber 112. Other known methods of attaching the viewing portion 192 to the main section 102 may be used (e.g., liquid sealants).

In some embodiments, including the illustrated embodiment, the shape of the user compartment 116 within the main section 102 can be configured to allow the user 118 to freely move his arms during operation of the submersible 100. Additionally, the main section 102 may be further comprised of a hatch 114 (shown most clearly in FIGS. 1-4) to allow access into the user compartment 116. The outside surface of the hatch 114 may comprise a handle 160 to allow access to the submersible 100 from the outside. The user compartment 116 may further include means for opening the hatch from inside the submersible 100, such as a hatch or other mechanical or electrical release mechanism. For example, in some embodiments, the user compartment 116 may include an instrument panel including mechanical linkages or electronic controllers which may desirably include a throttle, an on/off switch by which the motor can be operated to control propulsion of the submersible 100, joysticks to control the direction of movement of the submersible 100, among other controls. Further, in some embodiments, including the illustrated embodiment, the submersible 100 can also include valves such as pneumatic valves to be used to control the volume inside the buoyancy bags 188, 190 in order to control the depth of the submersible 100.

The main section 102 may further include buoyancy bags 188, 190. The buoyancy bags 188, 190 may be located on either side of the main section 102. Desirably, the buoyancy bags 188, 190 are sized and positioned such that, when inflated, the buoyancy bags 188, 190 allow the submersible 100 to be balanced and stable when in the water. The buoyancy bags 188, 190 may be fluidly connected to one or more oxygen tanks 150. The oxygen tanks 150 are desirably located above the buoyancy bags 188, 190 within the main section 102. In some embodiments, the oxygen tanks 102 may be supported by the chassis 172. Desirably, the placement of the oxygen tanks 150 factors into the overall weight and balance of the submersible 100 such that the submersible 100 is optimally balanced and stable while in the water.

In some embodiments, including the illustrated embodiment shown in FIGS. 9 and 10, thruster mechanisms 136, 138, and steering mechanisms 144, 146, are located at the rear of the submersible 100. As discussed above, the thruster mechanisms 136, 138 are desirably waterjets comprising a propeller 140, 142 housed within a nozzle. The steering mechanisms 144, 146, as discussed above, direct the water and control the direction of movement of the submersible 100. The forces applied by electrical motors attached to the propellers 140, 142 of the thruster mechanisms 136, 138 desirably directly propel the submersible in the desired direction. The thruster mechanisms 136, 138 may be mechanically connected to the chassis 172 using any type of mechanical fastener. The thruster mechanisms 136, 138 and the steering mechanisms 144, 146 may be electronically or mechanically controlled by the user 118 from within the user compartment 116. In other embodiments, the thruster mechanisms 136, 138 and the steering mechanisms 144, 146 may be controlled remotely from a position outside the submersible 100.

FIG. 9 also depicts the submersible 100 with main body panels 128, 130 that desirably attach to either side of the main section 102 of the submersible 100 and to each wing 104, 106. The main body panels 128, 130 may be attached using any suitable means (e.g., mechanical fasteners). The main body panels 128, 130 provide a hydrodynamic surface to allow the submersible 100 to move easily through the water with minimal drag or resistance. The main body panels 128, 130 and desirably provide a non-sealing protective enclosure for the main section 102 of the submersible 100. In some embodiments, including the illustrated embodiment, the main body panels 128, 130 may not be solid but may include various openings to provide access to components located within the main section, such as the oxygen tanks 150.

Stabilizer mechanisms 120, 122 may be provided in openings on each wing 104, 106. As discussed above, the stabilizer mechanisms 120, 122 are desirably placed at the same radial distance from the center of gravity of the submersible 100. The stabilizer mechanisms 120, 122 provide force to lift and lower the front of the submersible 100 (for example, to change the attitude of the submersible 100) and also apply a force to rotate the submersible 100 from left to right or right to left depending on the direction of rotation of the stabilizer propellers 121, 123. The stabilizer propellers 121, 123 may be connected to one or more electric motors onboard the submersible 100.

As illustrated in FIGS. 8 and 12 and as discussed above, the submersible 100 may further include a tripod arrangement of support members or skis to support the submersible 100 on the ground or on the ocean or lake floor. The left ski 108 attaches to the left wing 104 opposite the intersection between the left wing 104 and the main section 102. Similarly, the right ski 110 attaches to the right wing 106 opposite the intersection between the right wing 106 and the main section 102. The third ski, the center ski 109, attaches to the bottom of the main section 102 of the submersible 100 as best illustrated in FIG. 12. In some embodiments, left ski 108, center ski 109, and right ski 110 are supported, directly or indirectly, by the chassis 172.

As discussed above, a number of attachment members may be provided on the submersible 100 to assist with transporting the submersible, to aid in towing or lifting objects or equipment, or for other reasons. Two attachment members, the left front attachment member 212 and the right front attachment member 214 are shown in FIG. 8. As discussed above in greater detail, other attachment members may also be included on the submersible 100.

Desirably, the submersible 100 remains vertically stable under water and when floating at the surface. In some embodiments, including the illustrated embodiment, the equalization of two opposite forces preferably keeps the unit neutrally buoyant and upright, as shown in FIG. 11. For example, the volume of air in the open observation chamber 112 and the user compartment 116, as well as the buoyancy bags 188, 190, results in an upward force acting to push the submersible towards the surface. Additionally, the overall weight of the unit (including components such as the batteries, motors, and ballast) provides a force acting in the opposite direction. In some embodiments, including the illustrated embodiment, this stability can be important with the aim of keeping the submersible 100 stable and upright in the water.

In the embodiment illustrated in FIG. 11, the arrows represent the volumes of enclosed air which can apply vertical forces (shown with up arrows) pushing the submersible 100 up to the surface, and further represent volumes of high density weight materials which can apply vertical forces (shown with down arrows) pushing the submersible 100 down towards the bottom. The point of neutrality, or neutral buoyancy, can be calculated, for example, by the volumetric equation which takes into consideration the location in space of all of the volumes providing upward and downward forces. In some embodiments, including the illustrated embodiment, the volume of the observation chamber 112 and the user compartment 116 provides a force acting to push the device 100 towards the surface, as indicated by arrow 376. Additionally, the volume of the buoyancy bags 188, 190 (FIG. 7) may provide additional upward force. The volume of high density weight materials, such as the center ski 109 and main section 102 and including battery compartment 196, motors, and ballast area 198 act to counteract the forces which act to cause the submersible 100 to rise to the surface of the water. These high density weight materials act in the direction as indicated by arrow 372; that is, to cause the submersible 100 to submerge in the water. Furthermore, the weight of the propulsion mechanism including thruster mechanisms 136, 138 may also act to submerge the submersible 100, as indicated by arrow 374. Additionally, the weight of the forward side support assemblies, acts to submerge the submersible 100, as indicated by arrow 370. In some embodiments, including the illustrated embodiment, approximately 30% of the total weight of the submersible 100 may be due to each of the forward side support assemblies (approximately 15% on each side), with approximately 40% of the weight distributed near the center of gravity of the submersible 100, and approximately 30% of the weight of the submersible distributed at the rear of the submersible 100 due mainly to the weight of the thrusters 136, 138. In some embodiments, including the illustrated embodiment, the total weight of the submersible 100 due to the forward side support assemblies is at least 15%, at least 17%, at least 20%, at least 24%, or at least 28%. In some embodiments, including the illustrated embodiment, the submersible 100 has a total weight (excluding the weight of the oxygen tanks 150) of less than about 4,000 lbs, more desirably less than about 3,500 lbs, even more desirably less than about 3,000 lbs, even more desirably less than about 2,500 lbs, and most desirably less than about 2,000 lbs.

As discussed above, in some embodiments, including the illustrated embodiment, a user 118 may vary the rate of ascent or descent of the submersible 100 by inflating or deflating the buoyancy bags 188, 190 or through other means such as dropping ballast. Safety equipment such as sensors, signals, or electronic controls may also be incorporated into submersible 100 in other embodiments, including the illustrated embodiment. This safety equipment may act to limit the rate of ascent or descent to set levels or may limit the maximum depth to which the submersible 100 may descend. In some embodiments, including the illustrated embodiment, emergency releasable weights located within the main section 102 may be dropped manually by the user 118 or automatically. After dropping these weights, the submersible 100 will float to the surface of the water. The center of gravity of the buoyancy bags 188, 190 is desirably positioned near the center of gravity of the submersible 100 to achieve a balanced, substantially upright configuration of the submersible 100, as shown in FIGS. 1-11. In some embodiments, including the illustrated embodiment, the center of gravity of the buoyancy bags 188, 190 is positioned within about 24 inches, within about 20 inches, within about 18 inches, within about 15 inches, or within about 6 inches of the center of gravity of the submersible 100.

To operate the submersible 100, the submersible 100 is placed into the water. To enter the user compartment 116, the user 118 may open the hatch 114 using the handle 160 and enter the compartment 116 without having to enter the water. Desirably, the user 118 enters the user compartment 116 feet first and extends his or her feet toward the rear of the user compartment 116. Desirably, the user 118 is sliding feet first into the user compartment 116 with the inflatable bags 230 deflated to provide a greater amount of space within the user compartment 116. The user 118 then desirably orients his or her body such that his or her head and shoulders are within the observation chamber 112 and the user 118 is in a face-down, almost horizontal position, with the head and shoulders raised at least about 20 degrees to at least about 35 degrees from horizontal. The user 118 may extend his or her arms out and to the front of his or her body to manipulate controls located within the observation chamber of the user compartment. Desirably, this movement places the user 118 in an inclined forward position with his or her legs trailing down and behind him or her. To adjust the user compartment 116 to fit users having different body shapes, the inflatable bags 230 (FIG. 14) may be placed in various locations within the user compartment 116. Once the bags 230 are inflated, the comfort of the user compartment 116 can be customized for the individual user 118 and apply pressure where the user 118 desires for comfort. As discussed above, the cushioning member 232 is desirably in direct contact with the user's body and offers maximum comfort without restraining the user's upper torso or impacting the mobility of the user's arms.

Preferably, the user 118 can control the speed of the submersible 100 by manipulating electronic or mechanical controls located within the user compartment 116. The submersible 100 can be configured to allow power to the motor or motors to be cut if the power level of the submersible 100 drops to a certain level with a low power or other warning signal also provided to the user 118. In other embodiments, including the illustrated embodiment, other steering components such as flaps or other control surfaces on the wings 104, 106 may be used to steer the device 100.

In some embodiments, including the illustrated embodiment, the submersible 100 can travel between the surface and a depth of approximately 500 feet, more desirably between the surface and a depth of approximately 1000 feet, or most desirably between the surface and a depth of approximately 1500 feet. In some embodiments, including the illustrated embodiment, the submersible 100 can desirably operate at a depth of at least 500 feet, more desirably at a depth of at least 1000 feet, or most desirably at a depth of at least 1500 feet. In some embodiments, including the illustrated embodiment, the submersible 100 can desirably operate at a depth of no more than 2500 feet, more desirably at a depth of no more than 2000 feet, even more desirably at a depth of no more than 1700 feet, or most desirably at a depth of no more than 1500 feet. In some embodiments, including the illustrated embodiment, the submersible 100 can reach speeds of between 2 and 20 knots, more desirably between 3 and 15 knots, and most preferably between 4 and 10 knots. In some embodiments, including the illustrated embodiment, the submersible 100 can desirably reach a speed of at least 2 knots, more desirably a speed of at least 4 knots, more desirably a speed of at least 6 knots, even more desirably a speed of at least 8 knots, and most desirably a speed of at least 10 knots.

Manipulating and transporting objects and installing equipment, such as oil and gas cabling, is often done by manned or autonomous submersible vehicles. These submersibles are often very large and heavy and are also expensive to operate. In some embodiments, including the illustrated embodiment, the submersible 100 can include a plurality of interactive members such as the manipulator arm 280 that can be used, for example, to transport and lay underwater cabling. Desirably the manipulator arm 280 is mechanically or electrically controlled by the user 118 from within the user compartment 116. In other embodiments, the manipulator arm 280 may be controlled by an operator on the surface of the water. In some embodiments, the manipulator arm 280 may be robotic arms such as those manufactured by Schilling Robotics.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone or in combination with other features of these inventions other than as expressly described above. While the disclosed embodiments are primarily directed to an underwater personal mobility device, aspects of the invention may be used in connection with other types of submersible devices. Thus, it is intended that the scope of the present inventions herein disclosed should not be limited by the particular disclosed embodiments described above, but should be determined only by a fair reading of the claims that follow.

What is claimed is:

1. An underwater personal submersible comprising:

a main section having a forward end and a rearward end, the main section including a user compartment and an observation chamber, at least one oxygen tank connected to the user compartment, at least one buoyancy compartment, and a propulsion mechanism comprising at least one thruster mechanism;

first and second forward side supports of the main section;

wherein the user compartment is configured to receive and support an operator in a face down orientation, the user compartment defining a first forwardly and outwardly arm receiving portion containing a controller for operating the underwater personal submersible and a second forwardly and outwardly arm receiving portion;

wherein the user compartment defines a support inclined upwards toward the forward end of the main section at least 20 degrees from horizontal when the underwater personal submersible is positioned on a horizontal surface and the first and second forwardly and outwardly arm receiving portions are configured to receive the operator's arms in an outstretched position with the controller within the first forwardly and outwardly arm receiving portion and below the operator's chest relative to the horizontal when the underwater personal submersible is positioned on the horizontal surface; and wherein the first forwardly and outwardly extending arm receiving portion extends onto one of the first and second forward side supports of the main section.

2. The underwater personal submersible of claim 1 further comprising at least one membrane at least partially defining an inflatable chamber within the user compartment.

3. The underwater personal submersible of claim 2, wherein said membrane provides cushioning for comfort and support of a user.

4. The underwater personal submersible of claim 3, wherein said membrane at least partially encloses a source of ballast.

5. The underwater personal submersible of claim 4, wherein the source of ballast is water permitted to enter the inflatable chamber.

6. The underwater personal submersible of claim 5 further comprising a valve to control the entry of ballast into the inflatable chamber.

7. The underwater personal submersible of claim 6, wherein the inflatable chamber occupies at least 20% of an inner volume of the user compartment.

8. The underwater personal submersible of claim 6, wherein the inflatable chamber occupies at least 30% of an inner volume of the user compartment.

9. The underwater personal submersible of claim 1, wherein the total weight of the underwater personal submersible is less than 4000 lbs.

10. The underwater personal submersible of claim 1, wherein the total weight of the underwater personal submersible is less than 3000 lbs.

11. The underwater personal submersible of claim 1 further comprising a plurality of attachment members configured such that the submersible can lift and transport an object while underwater and while remaining vertically stable.

12. The underwater personal submersible of claim 1 further comprising a manipulable member connected to the underside of the submersible and configured such that the submersible can lift and transport an object while underwater and while remaining vertically stable.

13. The underwater personal submersible of claim 1 further comprising:

a secondary ballast system comprising at least one inflatable membrane located within the user compartment enclosing a source of ballast and which is inflatable to conform to the user's body within the user compartment to provide comfort for the user during operation of the submersible.

14. The underwater personal submersible of claim 1, wherein the self-propulsion mechanism comprises a plurality of thruster mechanisms, each thruster mechanism comprising an inlet, a nozzle outlet, a propeller, and a steering mechanism, wherein the propeller directs water out of the nozzle outlet to propel the submersible in a determined direction and the steering mechanism is rotatable such that the submersible may be steered in the determined direction.

* * * * *